US012396545B2

(12) United States Patent
Wagner, II

(10) Patent No.: US 12,396,545 B2
(45) Date of Patent: Aug. 26, 2025

(54) RUNNING BELT

(71) Applicant: Tune Belt, Inc., Cincinnati, OH (US)

(72) Inventor: Richard S. Wagner, II, Loveland, OH (US)

(73) Assignee: TUNE BELT, INC., Cincinnati, OH (US)

( * ) Notice: Subject to any disclaimer, the term of this patent is extended or adjusted under 35 U.S.C. 154(b) by 320 days.

(21) Appl. No.: 18/344,321

(22) Filed: Jun. 29, 2023

(65) Prior Publication Data

US 2023/0337809 A1 Oct. 26, 2023

Related U.S. Application Data

(63) Continuation-in-part of application No. 29/834,015, filed on Apr. 8, 2022, now Pat. No. Des. 1,046,443.

(51) Int. Cl.
*A45F 3/14* (2006.01)
*A45F 3/00* (2006.01)

(52) U.S. Cl.
CPC ..... *A45F 3/005* (2013.01)

(58) Field of Classification Search
CPC ..... A45F 3/005; A45F 5/1516; A45F 3/14; A45C 13/02; A45C 1/04; A45C 11/002
USPC ..... 224/660
See application file for complete search history.

(56) References Cited

U.S. PATENT DOCUMENTS 1,920,401 A 8/1933 Kahn
2,711,202 A 6/1955 Freedman
4,029,243 A * 6/1977 Zerobnick ..... A45F 3/00 224/664
4,061,256 A 12/1977 Beer et al.
4,135,653 A 1/1979 Sieloff
4,432,477 A 2/1984 Haidt et al.
4,500,019 A 2/1985 Curley, Jr.
4,509,667 A 4/1985 Meldrum
4,526,298 A 7/1985 Boxer et al.
(Continued)

FOREIGN PATENT DOCUMENTS

CN 303110249 2/2015
WO D052449-001 9/2000

OTHER PUBLICATIONS

CyberDyer running belt, posted at amazon.com, first available May 30, 2017, retrieved on Jul. 19, 2023, online, https://www.amazon.com/dp/B06XPYWB9D (Year: 2017).
(Continued)

*Primary Examiner* — Adam J Waggenspack
(74) *Attorney, Agent, or Firm* — Sand, Sebolt & Wernow Co., LPA

(57) ABSTRACT

A running belt has a pouch that defines a primary compartment sized to receive at least a smartphone therein, and there is a divider within the compartment to divide the compartment into a front portion and a rear portion, wherein at least one of the front portion and the rear portion is adapted to retain the smartphone therein, and the divider defines an interior pocket that is divided into at least two portions by a panel within the pocket of the divider, and the pocket is sized to receive an item that is smaller than the smartphone therein, and the panel maintains a substantially constant shape of the divider when the item is inserted into or removed from the pocket and when the smartphone is inserted into or removed from the primary compartment.

20 Claims, 13 Drawing Sheets

(56) References Cited

U.S. PATENT DOCUMENTS

D293,387 S 12/1987 Wagner, II
4,913,326 A 4/1990 Echelson
4,966,322 A 10/1990 Zagorski et al.
4,974,762 A 12/1990 Boretsky et al.
5,105,309 A 4/1992 Baravaglio et al.
5,170,917 A 12/1992 Tourigny
5,318,084 A * 6/1994 Jackson ..... A45F 3/00 224/264
5,758,671 A 6/1998 Thim
5,794,769 A 8/1998 Tomlinson et al.
5,836,488 A 11/1998 Priestley
5,967,870 A 10/1999 Bertoncelli et al.
6,062,700 A 5/2000 Price
6,085,449 A 7/2000 Tsui
D458,021 S 6/2002 Willows et al.
6,618,906 B2 9/2003 Ciesiun
6,629,628 B1 10/2003 Canepari et al.
6,641,015 B2 11/2003 Huggins
6,698,636 B2 * 3/2004 Angus ..... A45F 3/00 224/660
6,728,556 B1 4/2004 Whitley
7,364,491 B2 4/2008 Updyke
7,410,083 B2 8/2008 Reid
7,493,663 B2 2/2009 Gorsen
7,681,855 B1 3/2010 Cashman et al.
D615,753 S 5/2010 Pomerantz
7,712,479 B2 5/2010 Sundarrao
7,819,293 B1 10/2010 O'Connell
7,848,512 B2 12/2010 Eldracher
8,016,107 B2 9/2011 Emsky
D653,028 S 1/2012 Willows et al.
8,302,769 B2 11/2012 Justiss
8,333,353 B1 12/2012 Silverman et al.
8,397,962 B1 3/2013 O'Connell
8,474,669 B2 7/2013 Rohrbach et al.
8,516,621 B2 8/2013 Woolery
8,608,036 B2 12/2013 Mori et al.
8,714,421 B2 5/2014 Norling
8,752,740 B2 6/2014 Morgan et al.
8,800,829 B2 8/2014 Bergenudd et al.
8,852,095 B2 10/2014 Schlottau et al.
8,857,683 B2 10/2014 Cameron et al.
8,915,361 B2 12/2014 Rayner
RE45,402 E 3/2015 Taylor
8,973,795 B2 3/2015 Chiu, Jr. et al.
8,978,943 B2 3/2015 Rohrbach et al.
8,978,944 B2 3/2015 Mori et al.
8,985,409 B2 * 3/2015 Willows ..... A45F 5/00 224/684
9,055,795 B2 6/2015 Larkin
9,078,478 B2 7/2015 Ross, Jr.
9,084,468 B2 7/2015 Conwell
9,101,323 B2 8/2015 Einarsson
9,107,299 B2 8/2015 Rayner
9,179,562 B2 11/2015 Rayner
9,210,992 B2 12/2015 Debeers
9,229,494 B2 1/2016 Rayner
9,271,532 B2 3/2016 Cole
9,271,561 B2 3/2016 Chang
9,277,804 B1 3/2016 Gennodie
9,317,076 B2 4/2016 Rayner
9,340,341 B2 5/2016 Farrell
9,345,310 B2 5/2016 Chiu, Jr. et al.
9,351,551 B2 5/2016 Morgan et al.
9,380,723 B2 6/2016 Rayner
9,439,314 B2 9/2016 Rayner et al.
9,445,659 B1 9/2016 Nix et al.
9,450,634 B2 9/2016 Rayner
9,510,655 B2 12/2016 Stratton
9,516,940 B2 12/2016 Lowry
9,521,868 B2 12/2016 Cobbett et al.
9,532,639 B2 1/2017 Kimble
9,532,893 B2 1/2017 Beers et al.
9,548,785 B2 1/2017 Rayner
9,549,598 B2 1/2017 Rayner et al.
9,578,903 B2 2/2017 Cobbett et al.
9,582,072 B2 2/2017 Connor
9,615,650 B2 4/2017 Soriano et al.
9,622,557 B1 4/2017 Beavers et al.
9,657,867 B2 5/2017 Zurawski
9,697,657 B2 7/2017 Anderson et al.
9,709,971 B2 7/2017 Ellis
9,712,202 B2 7/2017 Bao
9,717,311 B2 8/2017 Odashima et al.
9,743,745 B2 8/2017 Duddy
9,756,928 B2 9/2017 Cameron et al.
9,763,510 B1 9/2017 Miner
9,781,984 B2 10/2017 Baranski et al.
9,797,675 B2 * 10/2017 Voigt ..... F42B 39/007
9,854,861 B2 1/2018 Covelli et al.
9,877,523 B2 1/2018 Ellis
9,894,983 B2 2/2018 Hernandez et al.
9,900,041 B2 2/2018 Rayner
9,955,762 B2 5/2018 Rayner
9,962,111 B2 5/2018 Balakrishnan et al.
9,986,814 B1 6/2018 Nix et al.
10,002,635 B2 6/2018 Mack et al.
10,012,969 B2 7/2018 Ellis
10,018,300 B1 7/2018 De Michele
10,061,350 B2 8/2018 Magi
10,064,458 B2 9/2018 Griffin, II et al.
D831,340 S 10/2018 Pomerantz
D831,341 S 10/2018 Pomerantz
D831,342 S 10/2018 Farkas
10,085,517 B2 10/2018 Beers et al.
10,105,097 B2 10/2018 Markel
D835,402 S 12/2018 Pomerantz
10,149,521 B2 12/2018 Baranski et al.
10,164,676 B2 12/2018 Zerfus
10,172,396 B2 1/2019 Ellis
10,182,937 B2 1/2019 Smith et al.
10,188,186 B2 1/2019 Norman
D839,591 S 2/2019 Yamanaka
10,194,702 B2 2/2019 Cobbett et al.
10,213,647 B2 2/2019 Balakrishnan et al.
10,226,082 B2 3/2019 Ellis
10,227,721 B2 3/2019 Hatanaka et al.
10,234,934 B2 3/2019 Connor
10,271,587 B2 4/2019 Cobbett et al.
10,285,523 B2 5/2019 Pugsley
10,293,239 B2 5/2019 Balakrishnan et al.
10,299,554 B2 5/2019 Rayner
10,321,873 B2 6/2019 Connor
10,325,472 B1 6/2019 Harsdorff et al.
10,334,893 B2 7/2019 Cobbett et al.
10,334,938 B2 7/2019 Nix et al.
10,342,482 B1 7/2019 Lisy et al.
10,362,813 B2 7/2019 Cobbett et al.
10,362,855 B2 7/2019 Whang et al.
10,384,113 B2 8/2019 Balakrishnan et al.
10,398,200 B2 9/2019 Baranski et al.
10,413,020 B2 9/2019 Beers et al.
10,455,867 B2 10/2019 Donohoe et al.
D865,356 S 11/2019 Chen
10,470,973 B2 11/2019 Machado Pires
10,504,310 B2 12/2019 Anderson et al.
D872,460 S 1/2020 Arikawa
10,525,322 B2 1/2020 Balakrishnan et al.
10,548,380 B2 2/2020 Rayner et al.
10,559,184 B2 2/2020 Harsdorff et al.
10,568,369 B2 2/2020 Ellis
10,601,965 B2 3/2020 Sirichai
10,602,833 B2 * 3/2020 Powell ..... A45C 7/0086
10,617,198 B1 4/2020 De Michele
10,621,956 B2 4/2020 Inagaki et al.
10,660,427 B2 5/2020 Nix et al.
10,687,562 B2 6/2020 Donohoe et al.
10,716,377 B2 7/2020 Rayner
10,729,964 B2 8/2020 Balakrishnan et al.
10,758,017 B2 9/2020 Norman
10,758,182 B2 9/2020 Wang et al.
10,784,915 B2 9/2020 Montgomery
10,799,660 B2 10/2020 Klurfeld
10,813,388 B2 10/2020 Cobbett et al.

(56) References Cited

U.S. PATENT DOCUMENTS 10,820,652 B2 11/2020 Schlam et al.
10,827,809 B2 11/2020 Skahan
10,874,346 B1 12/2020 Lisy et al.
10,892,625 B1 1/2021 Franklin et al.
10,925,327 B2 2/2021 Cobbett et al.
10,932,501 B1 3/2021 Powell
10,945,502 B2 3/2021 Herrmann
10,951,968 B2 3/2021 Honeycutt
10,953,248 B2 3/2021 Yu et al.
10,973,310 B2 4/2021 Vlassis et al.
10,993,490 B2 5/2021 Markel
11,037,424 B2 6/2021 Harsdorff et al.
11,043,242 B2 6/2021 Mack et al.
11,071,364 B1 7/2021 Fowler
11,076,969 B2 8/2021 Meikle
11,120,909 B2 9/2021 Ellis
11,150,694 B2 10/2021 Markovsky et al.
11,166,540 B2 11/2021 Nix et al.
11,177,037 B2 11/2021 Sanders et al.
11,177,038 B2 11/2021 Sanders et al.
2002/0100108 A1 8/2002 Stuart
2002/0177495 A1 11/2002 Ciesiun
2003/0022737 A1 1/2003 Ciesiun
2003/0052143 A1 3/2003 Devine
2003/0230606 A1 12/2003 Devinie
2004/0031120 A1 2/2004 Cherian
2004/0067786 A1 4/2004 Sanfilippo
2004/0144814 A1 7/2004 Katsanevas
2004/0144815 A1 7/2004 Reid
2005/0056201 A1 3/2005 Jones et al.
2005/0082323 A1 4/2005 O'Hair
2005/0145657 A1 7/2005 Norberg
2005/0207698 A1 9/2005 Weiser
2005/0220529 A1 10/2005 Katsanevas
2005/0250974 A1 11/2005 Bailey et al.
2006/0011679 A1 1/2006 Santiago
2006/0016841 A1 1/2006 Shurm
2006/0076250 A1 4/2006 Kwasney
2006/0076375 A1 4/2006 Bhakta
2006/0076376 A1 4/2006 Kemery et al.
2006/0124675 A1 6/2006 Calicott
2006/0261107 A1 11/2006 Daniels
2006/0266776 A1 11/2006 Plakke
2007/0080077 A1 4/2007 Thormahlen
2007/0215663 A1 9/2007 Chongson et al.
2007/0262112 A1 11/2007 Butler et al.
2007/0286667 A1 12/2007 Katsanevas
2008/0011794 A1 1/2008 Daniel
2008/0047990 A1 2/2008 Morgan et al.
2008/0142129 A1 6/2008 Reasner et al.
2009/0014105 A1 1/2009 Shattuck
2009/0039122 A1 2/2009 Antonioni
2009/0265971 A1 10/2009 Cook
2009/0272774 A1 11/2009 Craig
2010/0155438 A1 6/2010 Halpin
2011/0000945 A1 1/2011 Mongan et al.
2011/0031290 A1 2/2011 Remo
2011/0108589 A1 5/2011 Kim
2011/0240493 A1 10/2011 Adams et al.
2011/0290833 A1 12/2011 Koerner
2012/0010593 A1 1/2012 Powell
2012/0025945 A1 2/2012 Yazadi et al.
2012/0055963 A1 3/2012 Phair
2012/0063066 A1 3/2012 Floit
2012/0080462 A1 4/2012 Hajarian
2012/0145755 A1 6/2012 Kahn
2012/0152990 A1 6/2012 Kulas
2012/0255092 A1 10/2012 Wilson, II et al.
2012/0312851 A1 12/2012 Rico
2013/0001263 A1 1/2013 Kai
2013/0020359 A1 1/2013 Green
2013/0098955 A1 4/2013 Lamey et al.
2013/0122974 A1 5/2013 Haramein
2013/0146623 A1 6/2013 Murray
2013/0326790 A1 12/2013 Cauwels et al.
2014/0263495 A1 9/2014 Koch
2014/0326770 A1 11/2014 Michelakis
2015/0136821 A1 5/2015 Sorenson
2015/0182008 A1 7/2015 Kattouf, II
2015/0201723 A1 7/2015 Rayner et al.
2015/0320190 A1 11/2015 Gaudet et al.
2016/0081462 A1 3/2016 Debeers
2016/0106201 A1 4/2016 Taylor
2016/0120733 A1 5/2016 Ishikawa et al.
2016/0135743 A1 5/2016 Cobbett et al.
2016/0140867 A1 5/2016 Aragones et al.
2016/0143424 A1* 5/2016 Stephens ..... A45F 3/005 224/676
2016/0192516 A1 6/2016 Thompson
2016/0309865 A1 10/2016 Chiang
2016/0324303 A1 11/2016 Mudge
2016/0353865 A1 12/2016 Sims
2017/0235338 A1 8/2017 Wong et al.
2017/0266501 A1 9/2017 Sanders et al.
2017/0332770 A1 11/2017 Miner
2017/0340095 A1 11/2017 Cameron et al.
2018/0029304 A1 2/2018 Pauli et al.
2018/0063306 A1 3/2018 Scannell, Jr.
2018/0137749 A1 5/2018 Varga
2018/0199641 A1 7/2018 Raso
2018/0206566 A1 7/2018 Ramirez et al.
2018/0255850 A1 9/2018 Sullum
2018/0295896 A1 10/2018 Donohoe et al.
2019/0048521 A1 2/2019 Meemaduma et al.
2019/0060099 A1 2/2019 Ciocarlic et al.
2019/0142087 A1 5/2019 Kelly
2019/0208879 A1 7/2019 Gawley
2019/0239605 A1 8/2019 Cooke et al.
2019/0328163 A1 10/2019 Grytsenko
2020/0029636 A1 1/2020 Kelly
2020/0121203 A1 4/2020 Ellis et al.
2020/0178628 A1 6/2020 Merrill et al.
2020/0275764 A1 9/2020 King
2020/0315267 A1 10/2020 Donohoe et al.
2021/0030091 A1 2/2021 Wasserman
2021/0108660 A1 4/2021 Russell-Clarke et al.
2021/0112897 A1 4/2021 Farmer
2021/0127816 A1 5/2021 Sirichai
2021/0137411 A1 5/2021 Hanna
2021/0177081 A1 6/2021 Schlam et al.
2021/0212398 A1 7/2021 Markel
2021/0219624 A1 7/2021 Miller
2021/0289856 A1 9/2021 Kishineff
2021/0304580 A1 9/2021 Harsdorff et al.
2021/0375453 A1 12/2021 Ellis
2023/0337809 A1 10/2023 Wagner, II

OTHER PUBLICATIONS

Tune belt sp2 running belt, posted at amazon.com, first available Sep. 1, 2022, retrieved on Jul. 19, 2023, online, https://www.amazon.com/Tune-Belt-SP2-No-Bounce-Weatherproof/dp/BOB77Y2T4S (Year: 2022).

Tune belt we built a better belt, posted at youtube.com, first available Nov. 14, 2022, retrieved on Jul. 19, 2023, online, https://www.youtube.com/watch?v=bDFAkXW5YuE (Year: 2022).

Ushake running belt, posted at amazon.com, first available Feb. 23, 2022, retrieved on Jul. 19, 2023, online, https://www.amazon.com/UShake-Running-Fitness-Exercise-Marathon/dp/B073XSHTWR (Year: 2022).

* cited by examiner

RUNNING BELT

REFERENCE TO RELATED APPLICATIONS

This application is a continuation-in-part and claims the benefit of U.S. Design Application Serial Number 29/834,015, filed on Apr. 8, 2022; the disclosure of which is incorporated herein by reference.

TECHNICAL FIELD

This disclosure is directed to a running belt.

BACKGROUND ART

Carrying a cell phone while exercising offers several benefits and reasons why individuals choose to have their phone with them. First, it offers accessibility. By keeping the cell phone and keys on their person, individuals can quickly access important information or make necessary calls or messages during their exercise sessions without interrupting the workout. Second, it allows the tracking of fitness data. Fitness apps and wearable devices can track and monitor various exercise metrics, such as distance, pace, heart rate, and calories burned. Carrying a cell phone allows individuals to utilize these apps and devices to gather and analyze data, monitor their progress, and set fitness goals. Third, it provides safety and communication. Carrying a cell phone ensures individuals can reach out for help or assistance in case of an emergency or unexpected situation. It provides a sense of security, especially when exercising alone or in remote areas. Fourth, it enables the enjoyment of music and entertainment. Many people enjoy listening to music or podcasts while exercising to enhance their workout experience and stay motivated. Having a cell phone on hand allows immediate access to favorite playlists or entertainment options. Fifth, it offers connection through social media. Carrying a cell phone ensure that individuals can taking pictures, texting, answering an email, or posting on social media based on where the person is or what they are doing—Snapchat, Instagram, Twitter, Facebook, while out, or during a running event, etc.

In addition to carrying a cell phone, individuals have other devices available for conveniently carrying or holding their cell phones (and keys or wallet/cash/credit cards) while exercising. Some exemplary devices are clips or armbands. Clips or holders are compact and lightweight devices that can be attached directly to clothing, such as waistbands or bra straps, keeping the cell phone or keys securely in place. Clips or holders provide a minimalist solution for individuals who prefer to keep their items within easy reach. Armbands are worn around the upper arm and feature a pocket or pouch to hold the cell phone. They offer a hands-free option, keeping the phone accessible without interfering with movement. Armbands are popular among runners and individuals engaging in arm-intensive exercises.

Other devices such as running belts or waistbands, which are specifically designed for carrying cell phones and keys during exercise. Running belts or waistbands are constructed with lightweight and moisture-wicking materials to ensure comfort and prevent irritation during physical activities. Typically, they offer the advantages such as being stretchable bands that can be adjusted to fit around the waist or hips, providing flexibility and a snug fit. Elastic waistbands often feature pockets to securely hold the cell phone and keys, preventing them from bouncing or shifting while running. Further, many running belts or waistbands come with zippered pouches that provide additional security for the stored items. The zipper ensures that the belongings stay in place, even during vigorous movements. These pouches may have separate compartments to keep the cell phone and keys organized. Still further, some running belts or waistbands feature expandable pockets that can accommodate larger cell phones or other items like energy gels, small water bottles, or wallets. They use stretchable materials or adjustable straps to hold the contents securely. Also, for safety purposes, some running belts or waistbands may incorporate reflective elements such as strips or logos. These increase visibility during low-light conditions, making the wearer more easily seen by motorists or other pedestrians.

Although running belts or waistbands are advantageous, they are not without their drawbacks. Running belts typically provide a limited amount of storage space compared to other carrying options like backpacks or hydration vests. If an individual needs to carry larger items such as water bottles or extra gear, a running belt may not be sufficient. Depending on the design and placement of the pockets, accessing items stored in a running belt can be somewhat cumbersome during a workout. It may require slowing down, stopping, or adjusting the belt to retrieve or stow away items, which can interrupt the flow of exercise. Despite efforts to create a snug fit, some running belts may still experience bouncing or shifting during vigorous activities, particularly if they are not properly adjusted or secured. This movement can be distracting or uncomfortable, potentially affecting the overall workout experience.

There are compromises to be made when choosing current running belts or waist packs/fanny packs. For instance, the most stretchy and breathable fabrics may not be sweat or weather resistant. Options that use zippers have constrictive openings. Fixed loops aren't adjustable and may be awkward to put on or step into. They may incorporate divider materials that don't stretch so they compromise the stretch of any stretchy material to which they are sewn.

SUMMARY OF THE INVENTION

The running belt or waistband detailed in the exemplary embodiments of the present disclosure addresses the drawbacks of previous configurations. The present disclosure provides varying examples of a running belt or waistband that addresses these drawbacks through innovative features such as anti-bounce technology (i.e., bounce free), increased securement of devices or objects, improved accessibility, or added storage options. Exemplary embodiments of the present disclosure may provide a divider within a primary compartment of a pouch, wherein the construction and configuration of the divider enables the pouch to stretch four ways. The pouch has a top front panel or pocket flap that can be tightly pulled over the top. Then, adjusting the belt around the waist stretches the pouch four ways to allow the pouch to expand, while stretching to hold what's inside snugly against the body. The configurations of the embodiments of the running belts shown herein preserves the maximum stretchiness and water-resistance of the outside pouch in a way the maximizes the performance of the running belt—snugness around the waist, functionality of using the divider for leverage, maintaining the shape of the compartment when phone isn't inside to make getting phone back inside easier, keeping the pocket water-resistant—and making getting things in and out more easily and quickly because of this functionality.

In one aspect, an exemplary embodiment of the present disclosure may provide a running belt or waistband that utilizes a combination of different materials that results in a running band that is bounce-free or substantially bounce-free (because these materials stretch but the materials provide enough support) when the belt is donned or worn by a user. The belt includes a divider within a main or primary compartment of a pouch. One embodiment has an opening to the primary compartment of the pouch that is a flap or overlap opening that may be selective opened and closed and connected with a hook-and-loop closure but without a zipper such that the opening isn't constricted or too small for the largest phones, and a user does not have to pack, unpack, and repack or fuss around to access an object or device, such as a phone, which results in easy access. The embodiments detailed herein provide separation and organization, water resistance, comfort and adjustment.

One exemplary divider in the primary compartment of the pouch of the running belt functions to divide the primary compartment of the pouch into a first portion (e.g., a front compartment) and a second portion (e.g., a rear compartment). The divider may have its own pocket, which may have a zippered opening. The divider may be formed with material that surrounds or shrouds a rigid, semi-rigid, semi-flexible, or flexible panel. The pocket of the divider may be defined between the panel and the material that shrouds or surrounds the same. The pocket in the divider may be considered to be a sub-pocket relative to the primary compartment inasmuch as it is a pocket within a pouch. The pocket in the divider (i.e., the sub-pocket) keeps anything inserted inside the zip pocket part of the divider like a key fob, keys, a wallet or a credit card. The panel in the pocket of the divider eliminates bulkiness and retains shape such that the divider substantially does not bulge on at least one side of the divider (such as the back side of the divider). The panel enables the divider to remain flat on the back side thereof. This enables the divider to not obstruct the user when the user desired to slide a phone back into the main or primary compartment because the stiffness of the material forming the panel in the divider maintains the back or front side of the divider, as the case may be, flat and smooth. In one embodiment, the panel in the divider is formed from polypropylene (PP). The PP panel in the divider can be used to maintain a device or objects in the first portion or front compartment of the primary compartment out of the way and it then holds the flat space between the divider and the body so it makes it easy to slide the phone back. The material of the divider that shrouds or surrounds the PP panel stretches and so it tends to hold the phone very secure against the body maintaining stability and lack of movement of the phone inside the pocket. The divider also maintains the pocket's flat shape after the phone is removed, which again, aids getting the phone back inside, while preventing anything else inside from rounding out/rolling up.

Further, in this exemplary embodiment or another exemplary embodiment, the PP panel in the divider is connected or stitched to the ends of the elastic belt that are located within the pocket defined by elastic or elastane (such as Spandex® or Lycra®) material that shrouds or surrounds the PP panel, and collectively form the divider. The divider with the PP panel is incorporated in a way that does not inhibit the stretchiness or stretchability of the belt outer material forming the primary pouch or pocket. For example, the PP panel inside the divider is attached to the elastic belt inside an elastane shroud. The PP panel is sewn to the ends of the belt in a way that allows the divider as a unit to stretch (and thus hold a phone or other object behind it and next to the body more securely) and it permits the neoprene pouch to stretch. Because the neoprene pouch can still stretch, and together with the fact that it is more sturdy as compared to spandex, the stretching of the pouch in four directions, mainly horizontally around the waist, holds everything inside tight against the body when the elastic belt is stretched to secure the entire running belt around the waist because when the elastic belt is stretched, it also stretches the neoprene pouch. With the pouch stretched, it operates like a rubber band holding contents inside against the body. Thus, in this embodiment, if the PP panel was stitched to the pouch then the neoprene would not stretch horizontally and it would function no differently than nylon or some non-flexible, non-stretchable material, and then contents inside the pocket could bounce, which would be undesirable.

In another aspect, an exemplary embodiment of the present disclosure may provide a running belt that has a pouch that defines a primary compartment sized to receive at least a smartphone therein, and there is a divider within the compartment to divide the compartment into a front portion and a rear portion, wherein at least one of the front portion and the rear portion is adapted to retain the smartphone therein, and the divider defines an interior pocket that is divided into at least two portions by a panel within the pocket of the divider, and the pocket is sized to receive an item that is smaller than the smartphone therein, and the panel maintains a substantially constant shape of the divider when the item is inserted into or removed from the pocket and when the smartphone is inserted into or removed from the primary compartment.

In yet another aspect, an exemplary embodiment of the present disclosure may provide a running belt comprising: a pouch forming a primary compartment, and the primary compartment is adapted to carry a device; a divider within the pouch to divide the primary compartment into a first portion and a second portion, the divider comprising a panel surrounded by a first material, wherein a pocket is defined within the divider between the panel and the first material, and the pocket within the divider is adapted carry an item that is smaller than the device; and an adjustable belt connected to respective ends of the pouch and the belt is operable to retain the pouch about a portion of a user's body. This exemplary embodiment or another exemplary embodiment may further include a first surface on the panel; a second surface on the panel, wherein the second surface faces an opposite direction as the first surface; and a first portion of the first material proximate the first surface on the panel, wherein the first portion of the first material defines an opening that is selectively opened and closed. This exemplary embodiment or another exemplary embodiment may further include a zipper on the first portion of the first material that effectuates the opening to be selectively opened and closed. This exemplary embodiment or another exemplary embodiment may further provide that the zipper is laterally aligned. This exemplary embodiment or another exemplary embodiment may further include a first surface on the panel, wherein a first portion of the pocket within the divider is defined between the first surface of the panel and a front portion of the first material; and a second surface on the panel, wherein the second surface faces an opposite direction as the first surface, wherein a second portion of the pocket within the divider is defined between the second surface of the panel and a rear portion of the first material. This exemplary embodiment or another exemplary embodiment may provide that the pouch comprises a second material that is different than the first material. This exemplary embodiment or another exemplary embodiment may provide that the first material comprises elastane and the second material comprises neoprene. This exemplary embodiment or another exemplary embodiment may provide that the panel comprises PP. This exemplary embodiment or another exemplary embodiment may further include a top edge and a bottom edge on the panel; a first end and second end on the panel; and wherein the first end and the second end on the panel are directly or indirectly coupled to the first material, and the first material freely surrounds the top edge and the bottom edge on the panel. This exemplary embodiment or another exemplary embodiment may provide that the first material that freely surrounds the panel defines a front portion of the pocket and a rear portion of the pocket within the divider. This exemplary embodiment or another exemplary embodiment may further include a first end of the divider and second end of the divider; a top of the divider and a bottom of the divider; wherein the first end of the divider and the second end of the divider are directly or indirectly coupled with respective ends of the pouch; and wherein the pouch freely surrounds the top of the divider and the bottom of the divider, and wherein there is no connection of the bottom of the divider to the pouch such that the first portion of the primary compartment is in open communication with the second portion of the primary compartment below the divider, and wherein there is no connection of the top of the divider to the pouch such that the first portion of the primary compartment is in open communication with the second portion of the primary compartment above the divider.

In yet another aspect, an exemplary embodiment of the present disclosure may provide a method comprising: donning a belt having a pouch defining a primary compartment and having a divider located within the primary compartment, wherein the divider divides the primary compartment into a first portion and a second portion of the primary compartment; selectively inserting a device into either one of the first portion of the primary compartment or the second portion of the primary compartment; opening the divider to reveal a pocket within the divider; and inserting an item into the divider, wherein the item is smaller than the device This exemplary embodiment or another exemplary embodiment may provide that the divider includes a panel that divides the pocket into a first portion and the second portion, the method further comprising selectively inserting the item into either one of the first portion of the pocket or the second portion of the pocket. This exemplary embodiment or another exemplary embodiment may further include stretching a first material that surrounds the panel and defines the divider in response to insertion of the item, wherein the panel has a top edge and a bottom edge, and has a first end and second end, and wherein the first end and the second end on the panel are directly or indirectly coupled to the first material, and the first material freely surrounds the top edge and the bottom edge on the panel. This exemplary embodiment or another exemplary embodiment may further include stretching a second material that forms the pouch in response to insertion of the device, wherein the divider has a top edge and a bottom edge, and the divider has a first end and second end, and wherein the first end and the second end on the divider are directly or indirectly coupled to the second material, and the second material freely surrounds the top edge and the bottom edge on the divider. This exemplary embodiment or another exemplary embodiment may provide that opening the divider to reveal a pocket within the divider is accomplished by unzipping a laterally aligned zipper on a frontal portion of the divider. This exemplary embodiment or another exemplary embodiment may further include flexing a panel located within the pocket of the divider prior to inserting the item into the pocket of the divider, wherein the panel is flexed prior to inserting the device into either one of the first portion of the primary compartment or the second portion of the primary compartment, wherein the panel is formed from PP. This exemplary embodiment or another exemplary embodiment may further include opening the pouch via an overlap opening on a frontal portion of the pouch to provide access to the primary compartment. This exemplary embodiment or another exemplary embodiment may further include maintaining an exterior profile shape of the divider via a panel located within the pocket of the divider when the item is inserted into the pocket of the divider and when the item is removed from the pocket of the divider.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
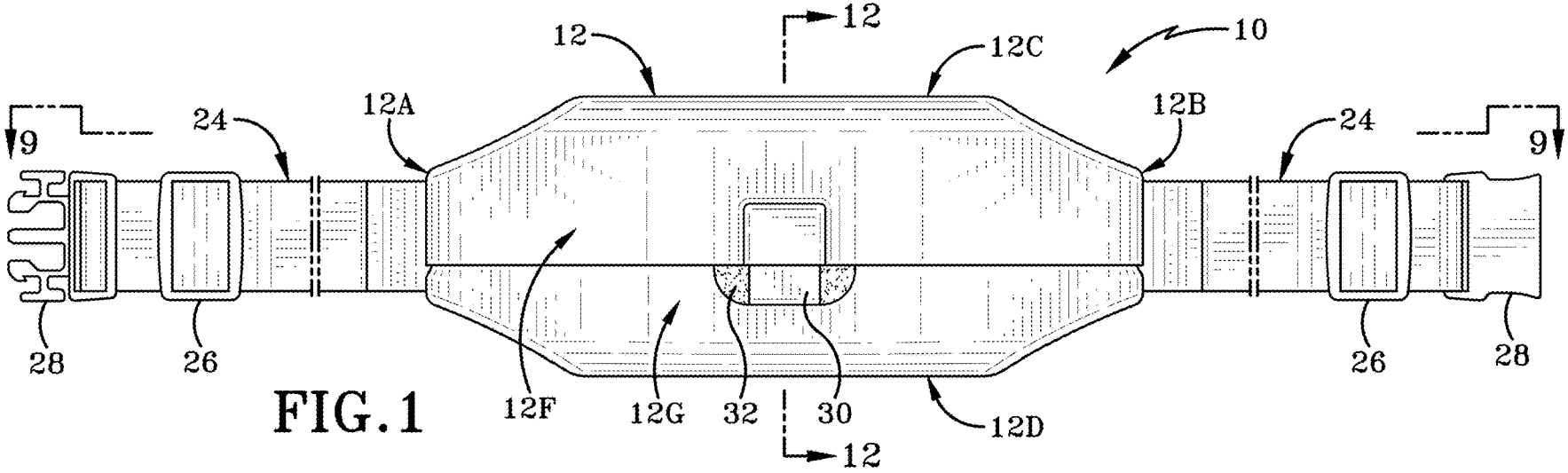
FIG. 1 is a front elevation view of a running belt in accordance with one exemplary embodiment of the present disclosure.

FIG. 1 through FIG. 10 depict one exemplary embodiment of a running belt generally at 10. Running belt 10 may also referred to generally as a waist band or, simply, belt 10. Thus, the term "running" should not be construed to be limiting as the belt 10 can be used for other activities for which a user or wearer of belt 10 desires to retain, carry or otherwise hold devices, objects or items with the belt. Further, while it is primarily envisioned that belt 10 will be word around a user's waist, it is to be understood that belt could be worn in different manners, such as a cross-body sling.

Belt 10 includes a pouch 12 forming a primary compartment 14. The primary compartment 14 is adapted to carry a device, such as a cellphone or smartphone, wallet, or other similarly sized device. Belt 10 includes a divider 16 within the primary compartment 14 of pouch 12 to divide the primary compartment 14 into a front or first portion 14A and a rear or second portion 14B. The divider 16 includes a panel 18 surrounded or shrouded by a shroud 20 of first material. In one embodiment, the first material that forms the shroud 20 is elastane (e.g., LYCRA® or SPANDEX®) or comprises elastane or consists essentially of elastane. A pocket 22 is defined within the divider 16 and is located between the panel 18 and the first material of shroud 20. The pocket 22 within the divider is adapted carry an item that is smaller than the device. For example, the item carried within pocket 22 may be a key, credit card, coins, cash or other money, or other similarly sized item that is smaller than the device. Belt 10 also includes a belt 24. Belt 24 may be adjustable via adjustment slides 26 and releasably connected to itself via a connector 28. The belt 24 may be connected to respective ends 12A, 12B of the pouch 12 and the belt 24 is operable to retain the pouch about a portion of a user's body.

Figure 2:
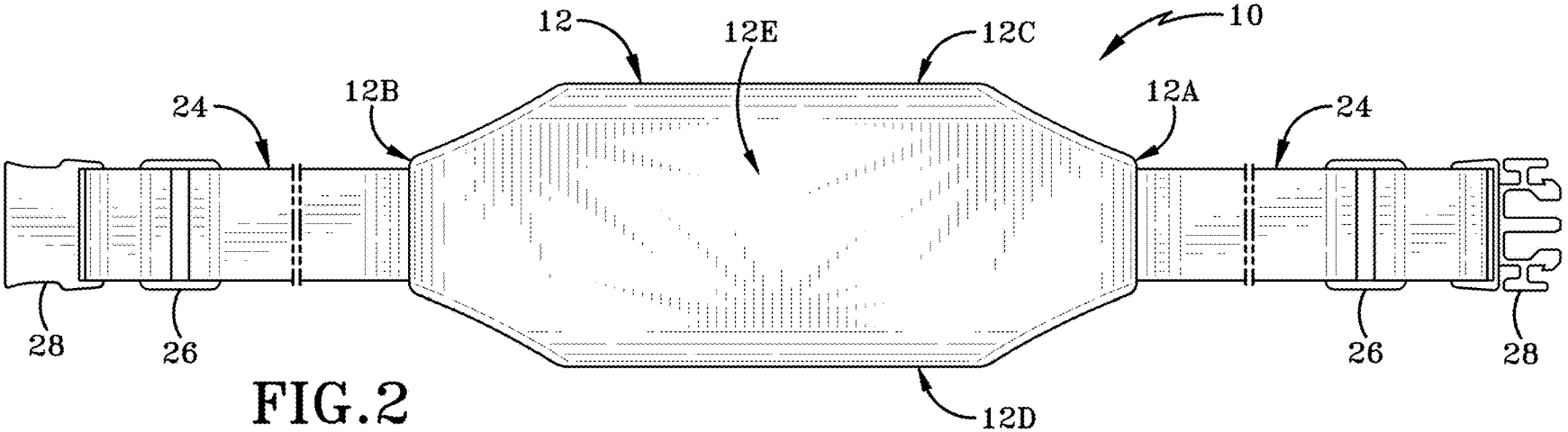
FIG. 2 is a rear elevation view thereof.
Figure 3:
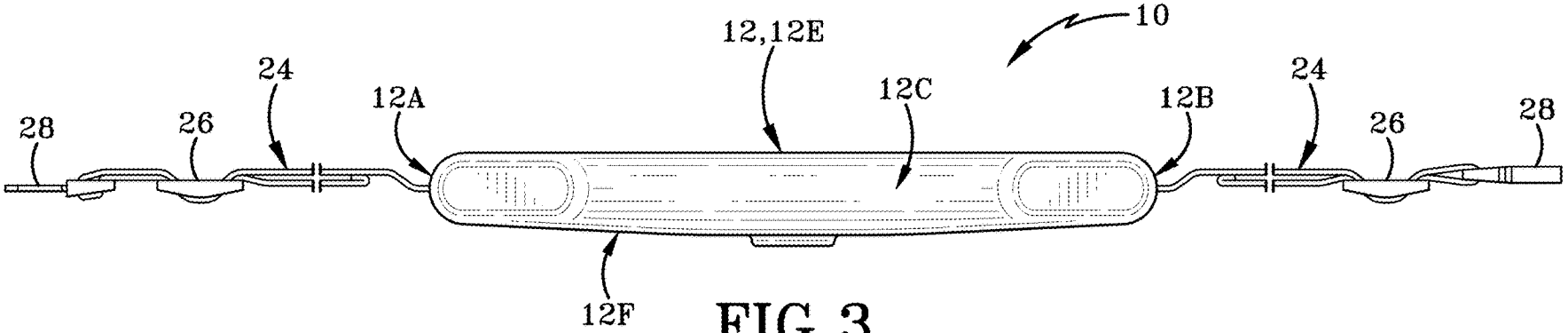
FIG. 3 is a top plan view thereof.
Figure 4:
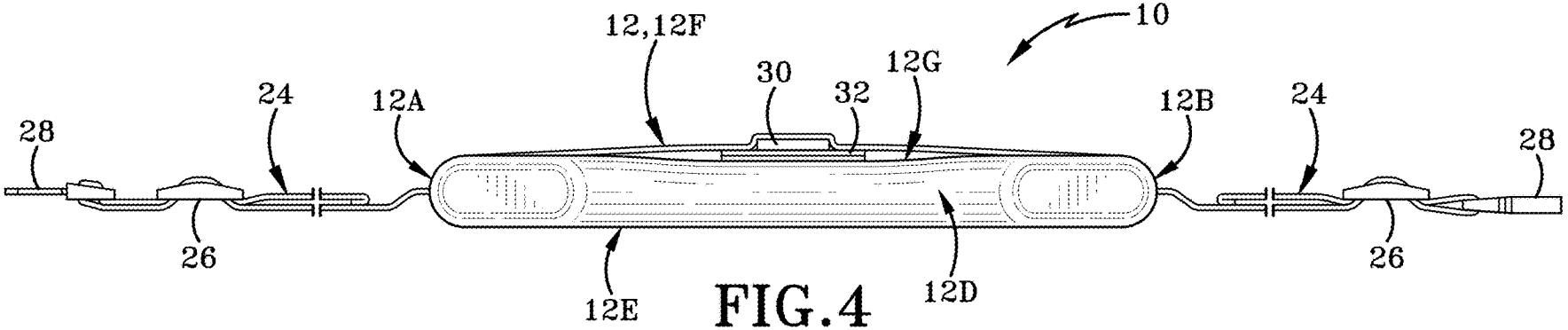
FIG. 4 is a bottom plan view thereof.
Figure 5:
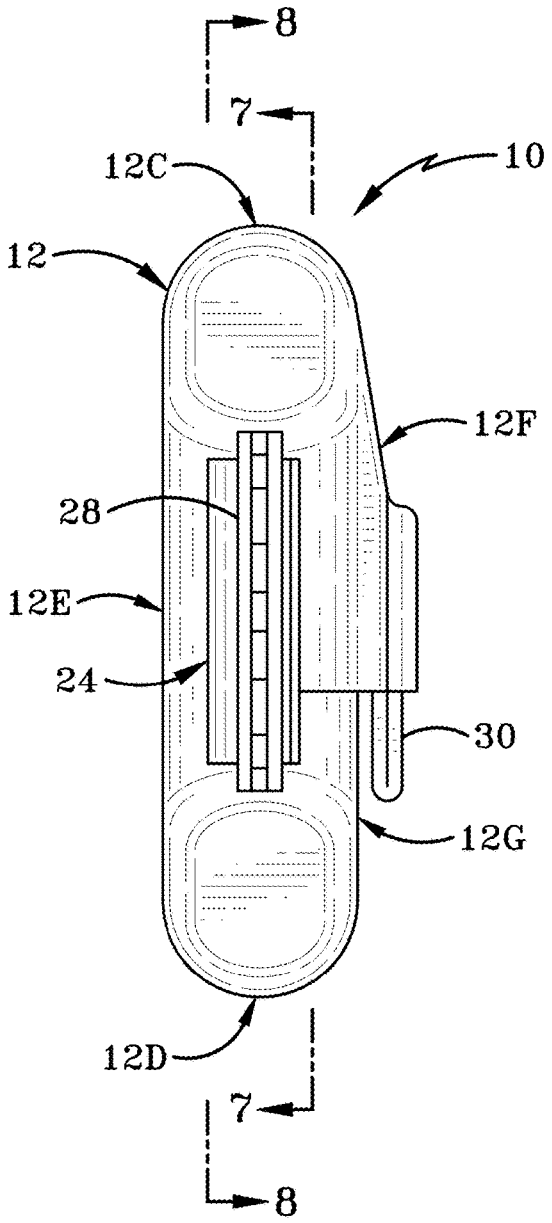
FIG. 5 is an enlarged first end elevation view thereof.
Figure 6:
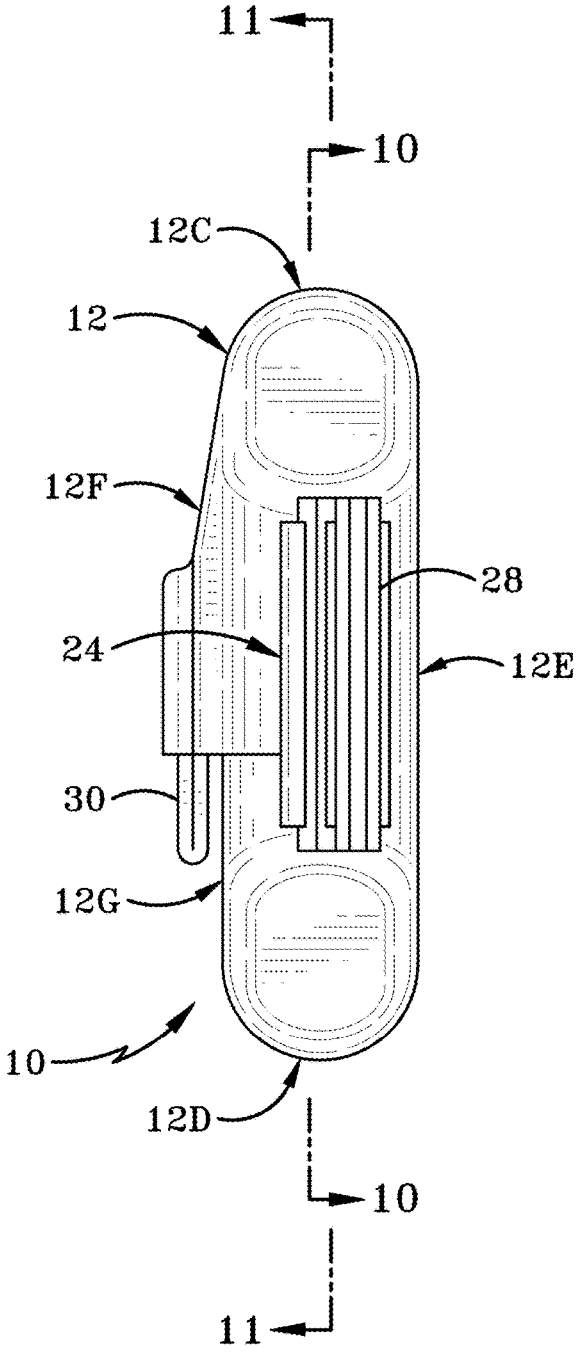
FIG. 6 is an enlarged second end elevation view thereof.

FIG. 1 and FIG. 2 depict pouch 12 as laterally extending between first end 12A and second end 12B. Pouch 12 includes a top edge 12C that extends in the lateral direction and a bottom edge 12D that extends in the lateral direction vertically below top edge 12C. Top edge 12C has respective lateral ends that transition or taper downward to the first end 12A and the second end 12B respectively. The tapered end portions of the top edge 12C may be formed by folding a portion of the different second material that forms the pouch 12. In one particular embodiment, the different second material forming pouch 12 may be neoprene, comprise neoprene, consist neoprene, or consist essentially of neoprene. The bottom edge 12D includes lateral ends that taper upward into the respective ends 12A, 12B and mirror that of the top edge 12C relative to an imaginary horizontal centerline or horizontal axis 38 (see FIG. 10). Rear panel 12E of the pouch 12 may be formed from a continuous piece of material as shown in FIG. 2. There may be two panels that collectively form the front panels of the pouch 12. There may be a top front panel 12F and a bottom front panel 12G that define an opening to the primary compartment 14 therebetween. A pull-tab 30 may be in operative communication with a hook and loop connector 32 that selectively permit open and closure of the opening to the primary compartment between top front panel 12F and bottom front panel 12G. Pull-tab 30 extends vertically downward from the lower edge of the top front panel 12F. The opening to the pouch 12 may be considered a flap opening or overlap opening based on the arrangement and configuration of the top front panel 12F and bottom front panel 12G.

Overall the shape of the pouch 12 takes the form of an elongated octagon in which the outer perimeter of pouch 12 is symmetric relative to a horizontal axis 38 and symmetric relative to a vertical axis. However, other configurations of pouch 12 are entirely possible. For example pouch 12 could have a circular perimeter, a rectangular perimeter, or any other geometric configuration or shape that still includes the other features detailed herein.

FIG. 7 through FIG. 10 depict the divider 16 within the primary compartment 14. The divider 16 includes a first end 16A, a second end 16B, a top edge 16C, and a bottom edge 16D. Divider 16 includes a front surface 16E opposite a rear surface 16F. The first end 16A and the second end 16B may be indirectly coupled to the first end 12A and the second end 12B of the pouch 12, respectively. In one particular embodiment, the first end 16A of the divider 16 is fixedly connected via stitching or other mechanical or chemical connections to the belt 24 within the primary compartment 14. In this particular embodiment, the second end 16B of the divider 16 is fixedly connected by stitching or other mechanical or chemical connections to the belt 12 within the primary compartment 14.

Figure 7:
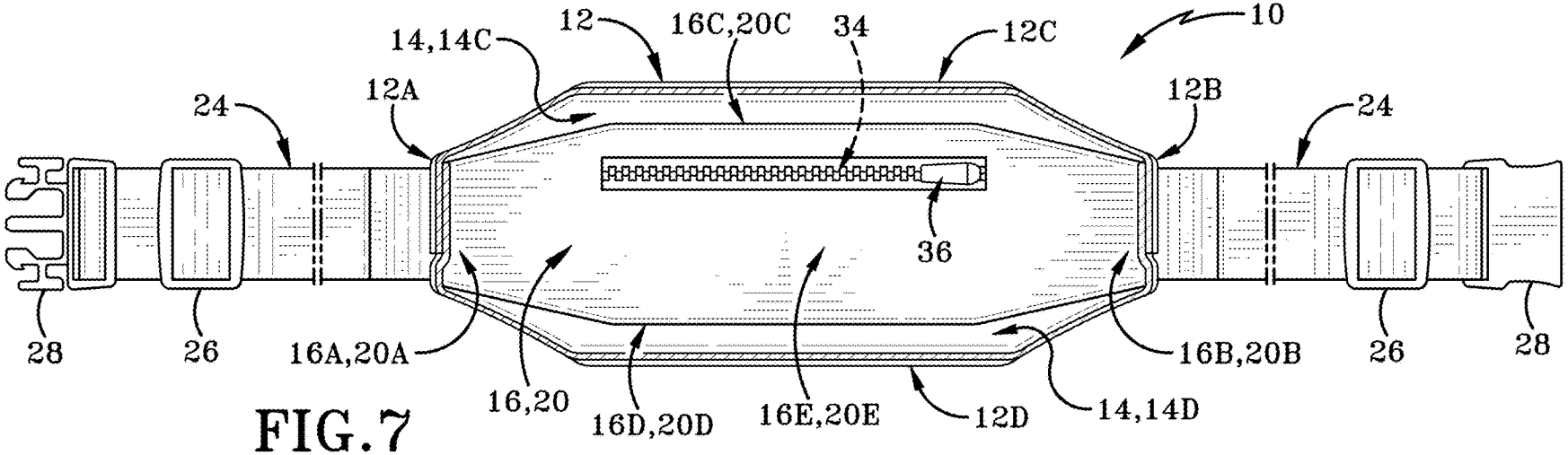
FIG. 7 is a cross section elevation view taken in the direction of line 7-7 in FIG. 5.
Figure 8:
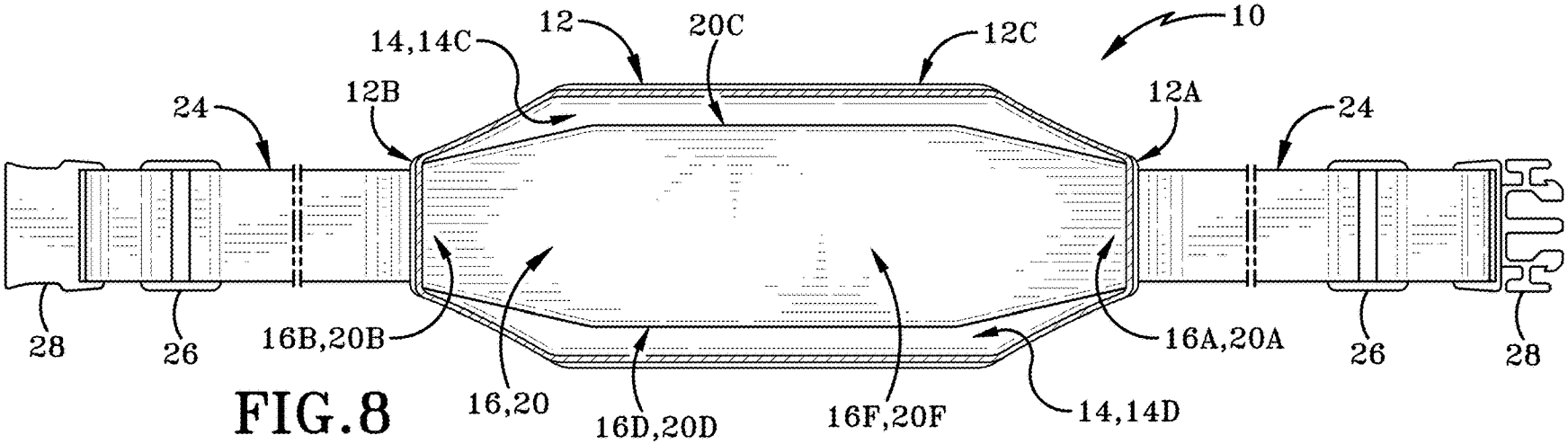
FIG. 8 is a cross section elevation view taken in the direction of line 8-8 in FIG. 5.
Figure 9:
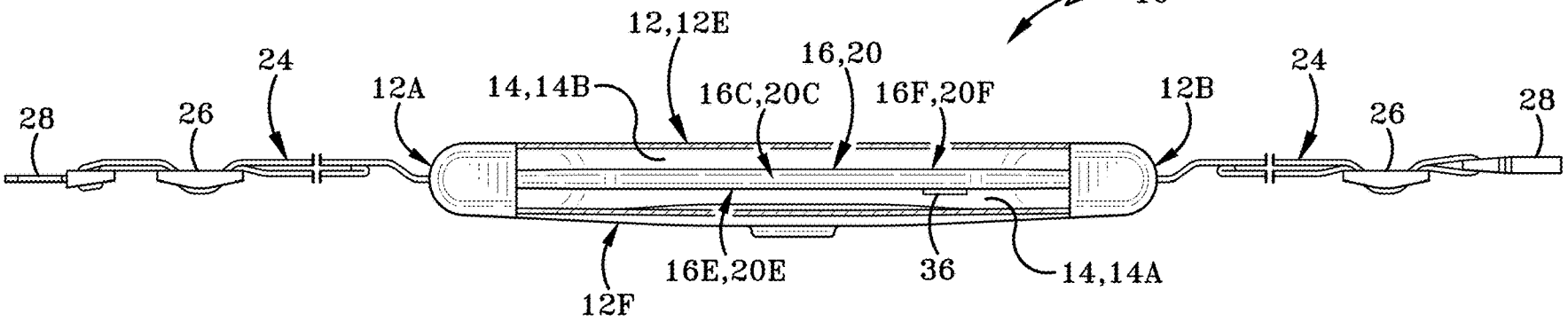
FIG. 9 is a cross section top plan view taken in the direction of line 9-9 in FIG. 1.

As shown in FIG. 7 and FIG. 8, the divider has a vertical dimension measured between the top edge 16C and the bottom edge 16D that is less than the vertical dimension of the primary compartment 14 such that a space or top space 14C of the primary compartment 14 is present between the top edge 16C of divider 16 and the top edge 12C of pouch 12. Further, there is a space or bottom space 14D between the bottom edge 16D and the bottom edge 12D of pouch 12. The top space 14C and the bottom space 14D allow the front portion or first portion 14A of the primary compartment 14 to be in open communication with the second portion or rear portion 14B of the primary compartment 14. More particularly, the top space 14C establishes that there is no connection of the top edge 16C of divider 16 to the pouch 12 such that the first portion 14A of the primary compartment in in open communication with the second portion 14B of the primary compartment above the divider 16. Additionally, there is no connection of the bottom of the divider 16 to the pouch 12 such that the space 14D causes the first portion 14A of the primary compartment 14 to be in open communication with the second portion 14B of the primary compartment 14 below the divider 16.

Figure 10:
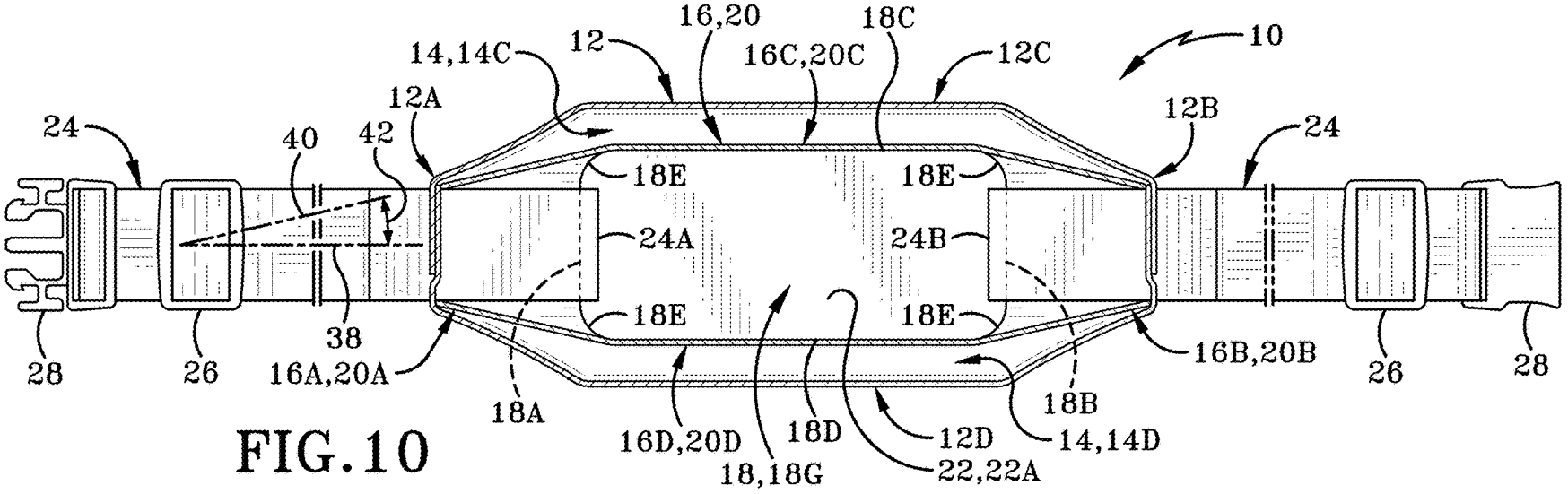
FIG. 10 is a cross section elevation view taken in the direction of line 10-10 in FIG. 6.
Figure 11:
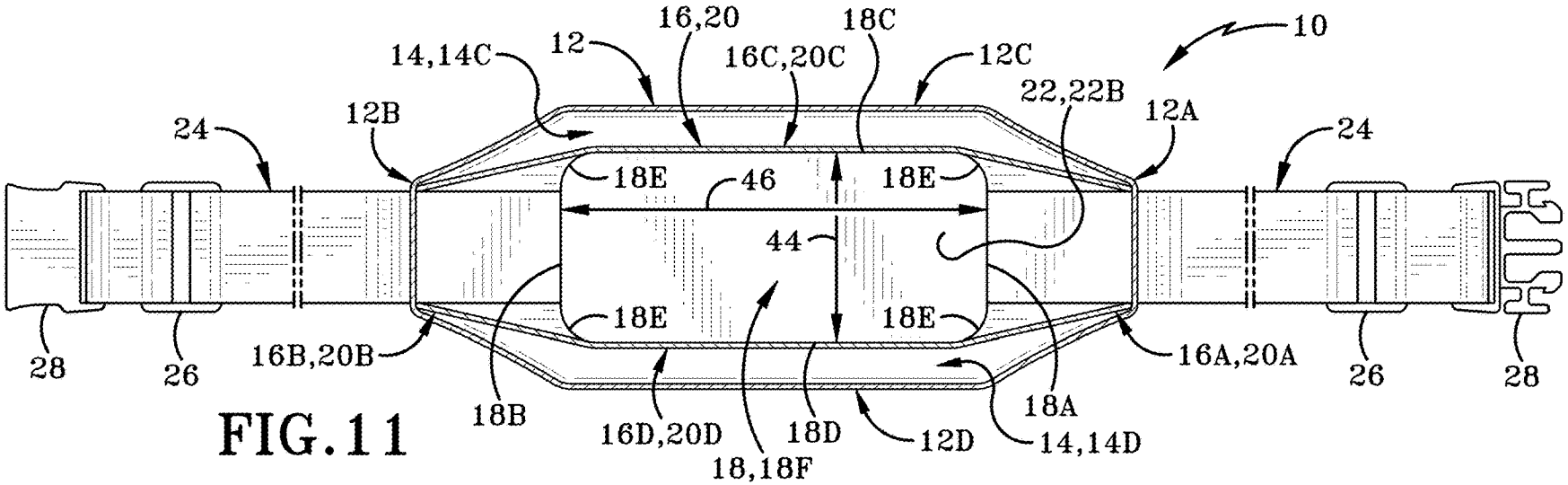
FIG. 11 is a cross section elevation view taken in the direction of line 11-11 in FIG. 6.
Figure 12:
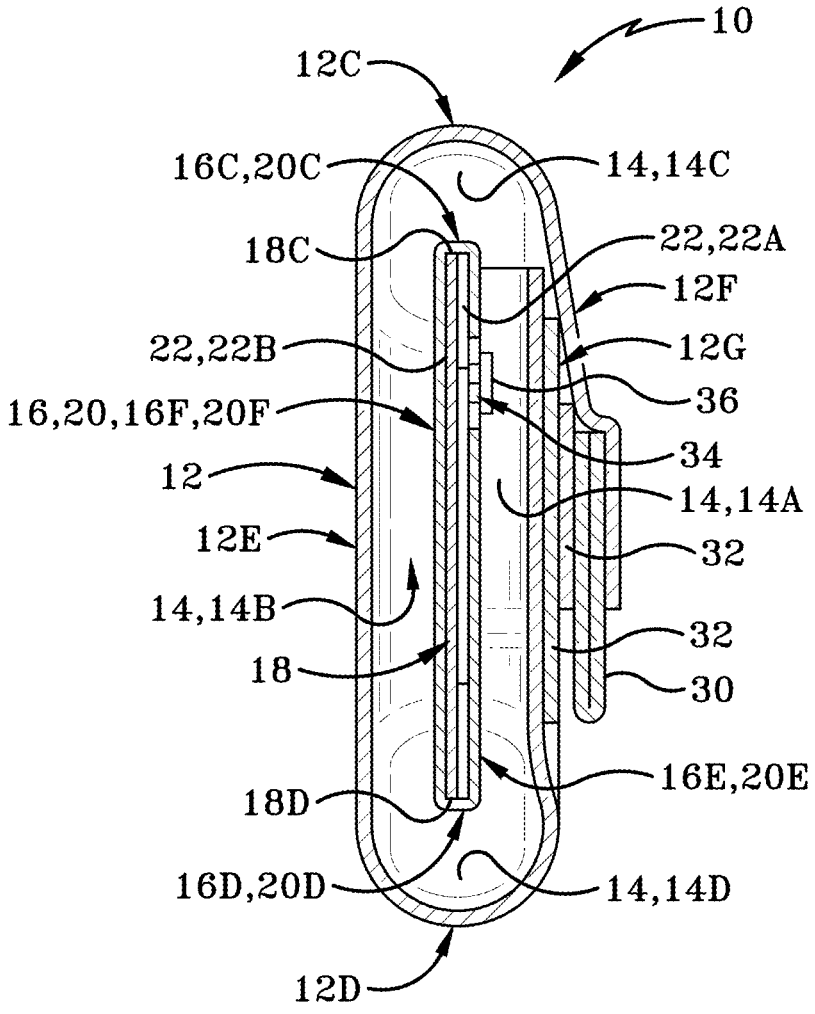
FIG. 12 is a cross section side elevation view take in the direction of line 12-12 in FIG. 1.

The shroud 20 includes a first end 20A that is collocated with the first end 16A of divider 16 and the shroud 20 includes a second end 20B that is collocated with the second end 16B of divider 16. The respective ends 20A, 20B of shroud 20 are directly or indirectly coupled to pouch 12. In one particular embodiment, the ends 20A, 20B of shroud 20 are fixedly connected to the respective first and second ends 12A, 12B of pouch 12. Shroud 20 includes a top edge 20C and a bottom edge 20D. As depicted in FIG. 10 and FIG. 11 the top edge 20C and the bottom edge 20D of shroud 20 freely surround the panel 18 and contact the panel 18 but are not fixedly connected thereto. This allows the panel 18 to freely move within the pocket 22 within the divider 16, but also allows the first material to freely stretch relative to the panel 18.

The shroud 20 formed of the first material includes a front or first portion 20E and a rear portion 20F. There may be an opening 34 formed in the front portion 20E that permits access to the pocket 22 within the divider 16. The opening 34 may be a laterally aligned or horizontally aligned zippered opening effectuated by zipper 36.

With continued reference to FIG. 10 and FIG. 11, panel 18 includes a first end 18A and a second end 18B. Panel 18 includes a top edge 18C and a bottom edge 18D. The first end 18A of panel 18 is connected with an end 24A of belt 24 within pocket 22 of divider 16. The second end 18B of panel 18 is connected to a second end 24B of belt 24 within the pocket 22 of divider 16. The connections of the ends 24A, 24B of belt 24 to the panel 18 may be accomplished through stitching or another mechanical, chemical, or non-mechanical and non-chemical connection manners. Stated otherwise, the ends 24A, 24B of belt 24 are disposed within the pocket 22 defined by the first material forming shroud 20 of divider 16.

The panel 18 has a generally rectangular configuration that is horizontally elongated. Panel 18 is formed from a semi-flexible material that retains its shape under ordinary forces, however is able to be flexed or bent in response to a force that overcomes the strength of the material. One exemplary material that forms panel 18 is polypropylene (PP). The PP material forming panel 18 allow the panel to retain its shape within the first material that forms shroud 20 and allows it to remain horizontally elongated in a generally rectangular configuration as shown in FIG. 10 and FIG. 11. The orientation of the panel 18 causes the divider to have an elongated octagonal configuration as shown in FIG. 10 and FIG. 11, as well as shown in FIG. 7 and FIG. 8.

FIG. 10 depicts that the top edge 20C of shroud 20 tapers at respective ends of the shroud 20 relative to horizontal axis 38. The tapering portion of the top edge 20C of shroud 20 that is associated with the first end 20A of shroud 20 tapers along plane 40. Plane 40 intersects horizontal axis 38 at an angle 42. Angle 42 may in a range from about 15 degrees to about 45 degree. However, other angles are entirely possible for angle 42. For example, in one particular embodiment angle 42 defined between plane 40 and horizontal axis 38 is about 40 degrees. In one particular embodiment, the tapering portion associated with the second end 20B of shroud 20 tapers at a similar angle relative to horizontal axis 38.

Panel 18 includes a vertical dimension 44 and a lateral dimension 46. The vertical dimension 44 of panel 18 may be in a range from about 2 inches to about 4 inches. In one particular embodiment, the vertical dimension 44 of panel 18 is approximately 2.75 inches. The lateral dimension 46 of panel 18 may be in a range from about 4 inches to about 8 inches. In one particular embodiment, the lateral dimension 46 of panel 18 is approximately 6 inches. Panel 18 may have rounded corners 18E when panel 18 is arranged or configured as a laterally elongated rectangle. Panel 18 has a first or front surface 18G that is bound by the first end 18A, second end 18B, top edge 18C, bottom edge 18D, and rounded corners 18E. Panel 18 has a second or rear surface 18F that is bound by the first end 18A, second end 18B, top edge 18C, bottom edge 18D, and rounded corners 18E. The first or front surface 18G faces an opposite direction as the second or rear surface 18F. A first or front portion 22A of pocket 22 is defined between the first or front surface 18G of panel 18 and the front portion 20E of shroud 20. A second or rear portion 22B of pocket 22 is defined between the second or rear surface 18F of panel 18 and the rear portion 20F of shroud 20.

Panel 18 (and panel 118, introduced below) may be formed of any suitable rigid or semi-rigid material having lower coefficient of friction (COF) than the material layers that form the pouch 12, and having high durability. The panel 18 may line or divide the interior of pocket 22, as discussed herein, and the rigidity of the material selected for panel 18 may support the structure of divider 16 when an item is not inserted therein. According to one aspect, panel 18 may be formed of a material having a low COF such as a polymer plastic, or other similar material. As used herein, a low COF (i.e. the ratio between friction force and normal force) is contemplated to include materials with a COF below 1, where a coefficient of 1 represents the point where friction force is equal to the gravity force of the weight of the material. In one particular embodiment, panel 18 is formed of PP. PP is a tough, durable, and flexible polymer that may impart some flexible rigidity into divider 16 while having a low COF to allow for ease of insertion and removal of items therefrom. PP, like all materials, has a varying COF dependent upon the type of material the PP interacts with; however, generally speaking, PP has an approximate dynamic COF between 0.28 (plastics to steel) to 0.44 (plastics to plastic) and a static COF of 0.30 (plastics to steel) to 0.76 (plastics to plastics). For reference, materials with a COF below 0.1 are considered lubricous materials (e.g. lubricants).

Having thus describe the exemplary configuration of belt 10, reference is now made to its operation and shown in FIG. 13A-FIG. 15B.

Figure 13A:
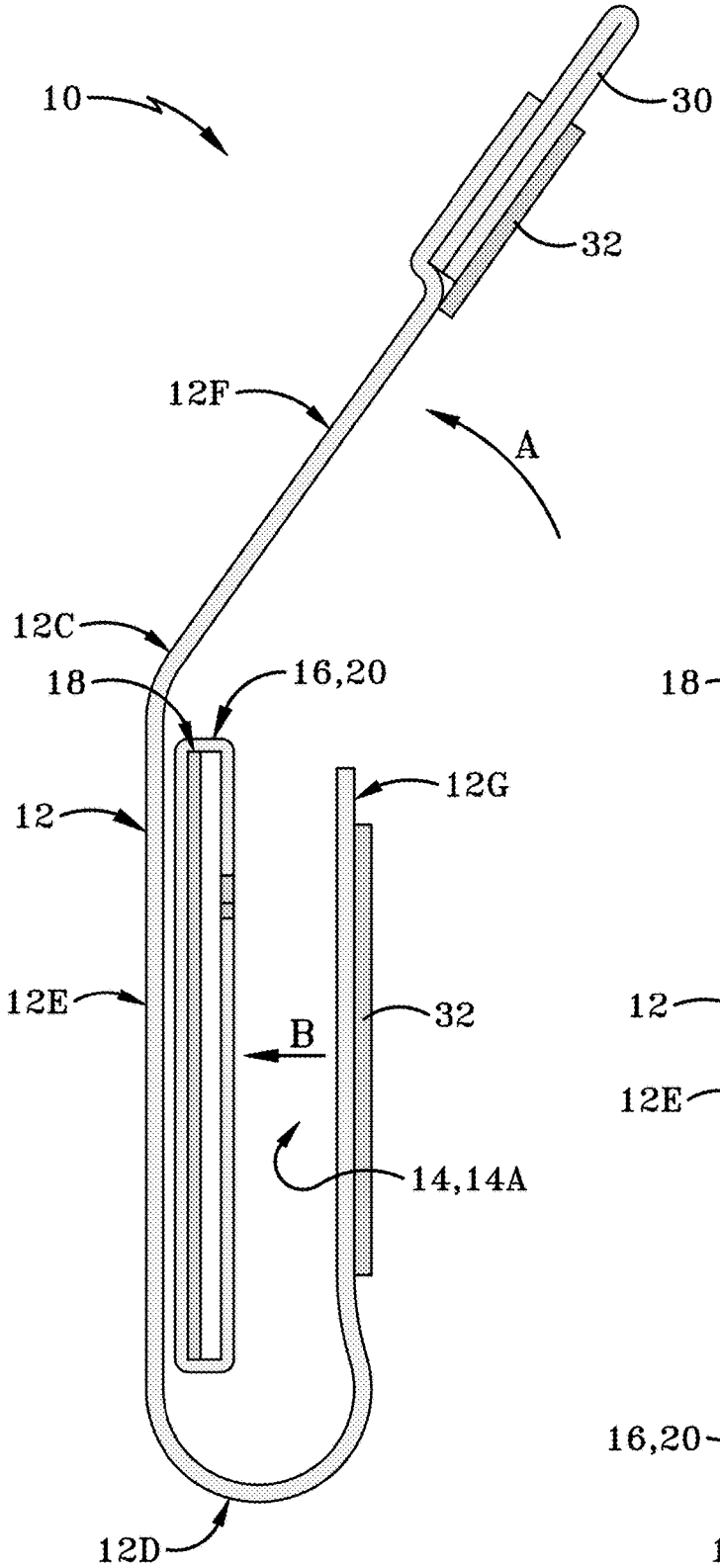
FIG. 13A is an operational diagrammatic side elevation view of the running belt with the divider being moved rearward.
Figure 13B:
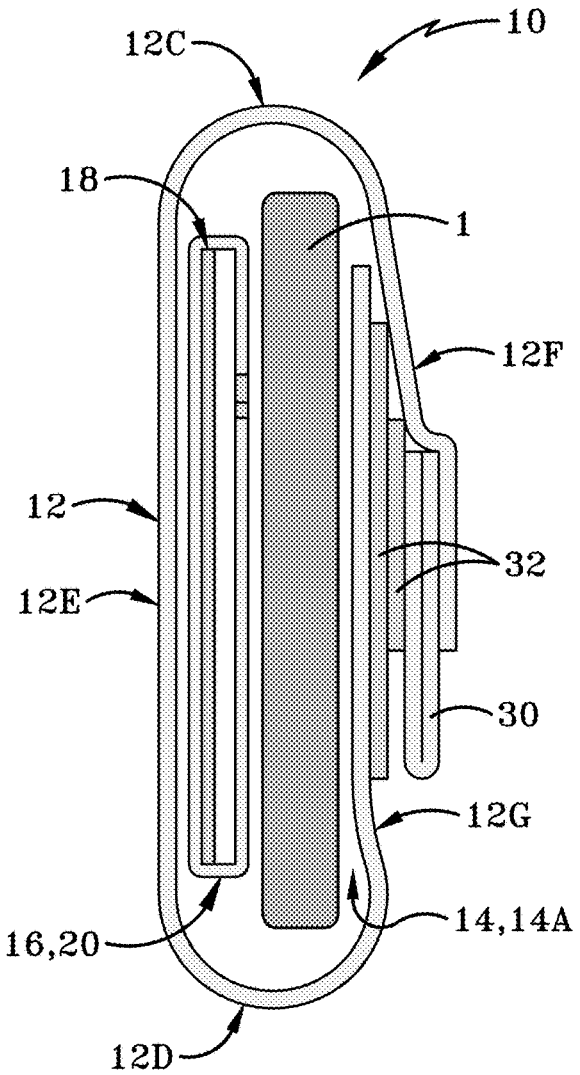
FIG. 13B is an operational diagrammatic side elevation view of the running belt with a device, such as a phone, inserted into the primary compartment forward of the divider.

In operation and with reference to FIG. 13A and FIG. 13B, a user or wear of belt 10 will don the belt 10 on their body, typically around their waist. The user may pull the pull tab 30 to release the connector 32 on top panel 12F from its connection with the corresponding connector 32 on bottom panel 12G. Once the connection of connectors 32 is release, the top panel 12F will be moved upward in the direction of Arrow A. The upward movement of top panel 12F will expose the opening to the primary compartment 14. With the top panel 12F raised in an upward or opened position, the user will move or press the divider in the rearward direction, as indicated by Arrow B. The movement of divider in the rearward direction of Arrow B will enlarge the frontal portion 14A of primary compartment 14 and decrease the rear portion 14B of the primary compartment 14. Then, with the divider 16 having moved from its normal or central position to a rear position, the user may insert a device 1 into the front portion 14A of primary compartment 14. Device 1 is diagrammatically shown but shall be understood to be a phone, smartphone, wallet or other similarly sized device that may fit within primary compartment 14. Thereafter, with the device 1 disposed in the front portion 14A of primary compartment 14, the user may move and return the top panel 12F to its previous position to connect connectors 32 to secure and close the flap opening of pouch 12.

Figure 14A:
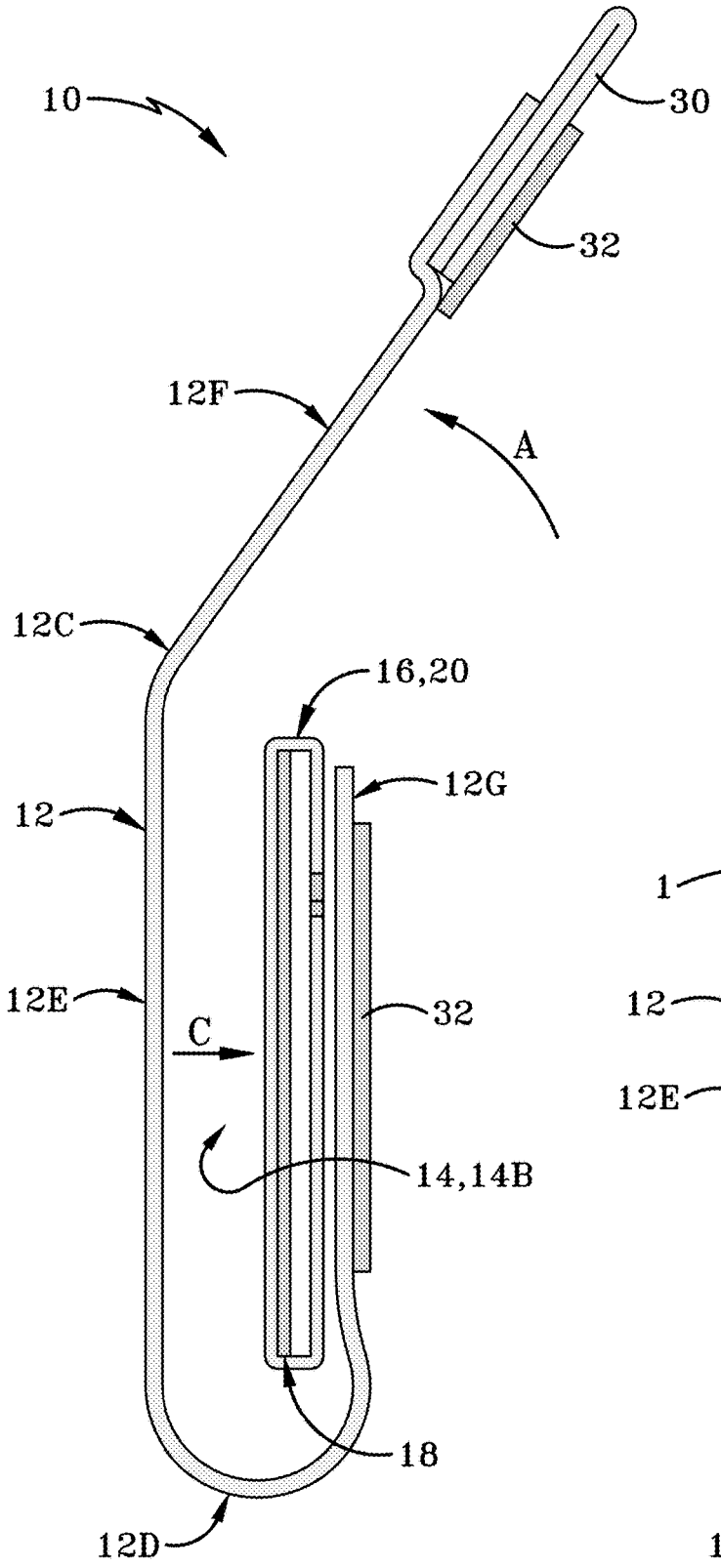
FIG. 14A is an operational diagrammatic side elevation view of the running belt with the divider being moved forward.
Figure 14B:
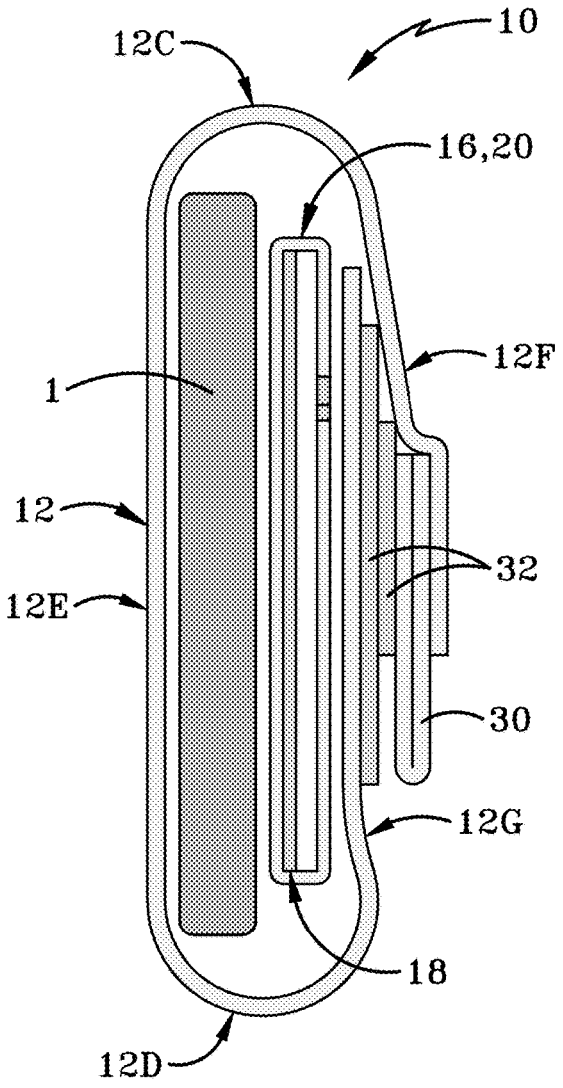
FIG. 14B is an operational diagrammatic side elevation view of the running belt with a device, such as a phone, inserted into the primary compartment rearward of the divider.

In operation and with reference to FIG. 14A and FIG. 14B, a user or wear of belt 10 will don the belt 10 on their body, typically around their waist. The user may pull the pull tab 30 to release the connector 32 on top panel 12F from its connection with the corresponding connector 32 on bottom panel 12G. Once the connection of connectors 32 is release, the top panel 12F will be moved upward in the direction of Arrow A. The upward movement of top panel 12F will expose the opening to the primary compartment 14. With the top panel 12F raised in an upward or opened position, the user will move or press the divider in the forward direction, as indicated by Arrow C. The movement of divider in the forward direction of Arrow C will enlarge the rear portion 14B of primary compartment 14 and decrease the forward portion 14A of the primary compartment 14. Then, with the divider 16 having moved from its normal or central position to a forward position, the user may insert the device 1 into the rear portion 14B of primary compartment 14. Thereafter, with the device 1 disposed in the rear portion 14B of primary compartment 14, the user may move and return the top panel 12F to its previous position to connect connectors 32 to secure and close the flap opening of pouch 12.

In addition to that which is shown in FIG. 13A-FIG. 14B, the primary compartment 14 may hold, secure and/or retain two devices 1. One device may be located forward of the divider 16 in the front portion 14A of the primary compartment 14 and another device may be located rearward of the divider in the rear portion 14B of the primary compartment 14. Because the pouch 12 freely surrounds the top portion 16C of divider 16 and freely surrounds the bottom edge 16D of divider 16, the second material forming pouch 12 can stretch and flex to permit the two devices to be snuggly secured in the primary compartment with the divider 16 located between the two devices. This arrangement also allows the second material, such as neoprene (closed cell material and waterproof), to not be compromised by small holes from the stitch punctures which can allow moisture to get into the pocket, and therefore, the design without stitching, whereby a single piece of neoprene wrapped over itself to form a protective hood over the opening allows maximum protection from sweat and weather. In this embodiment when two devices 1 (or objects) are used, one of the devices will likely be a cell phone whereas the other device will be another object, such as lip balm, food, snacks, or another object larger than item 2.

Figure 15B:
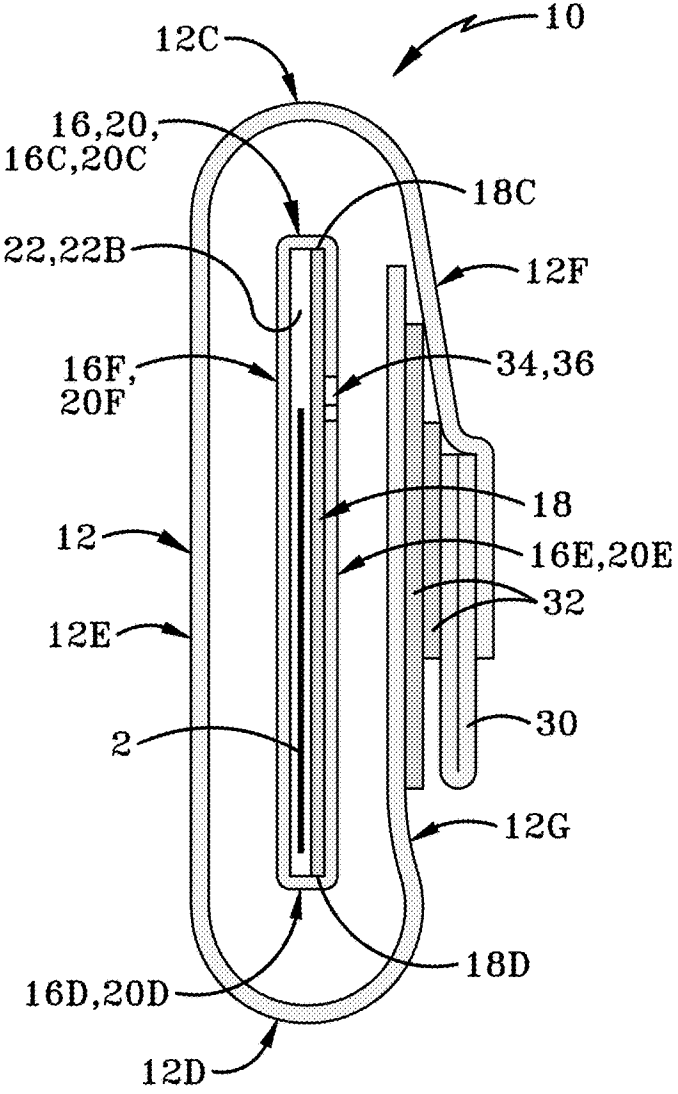
FIG. 15B is an operational diagrammatic side elevation view of the running belt with an item, such as a credit card, inserted into the pocket of the divider and rearward of the panel.
Figure 15A:
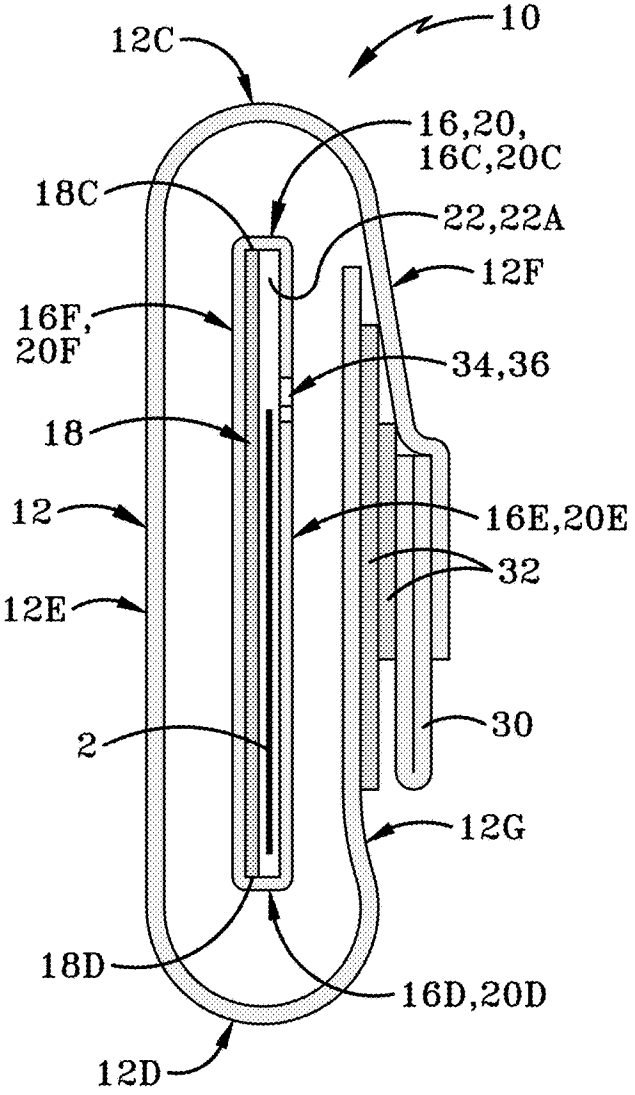
FIG. 15A is an operational diagrammatic side elevation view of the running belt with an item, such as a credit card, inserted into the pocket of the divider and forward of the panel.
Figure 16:
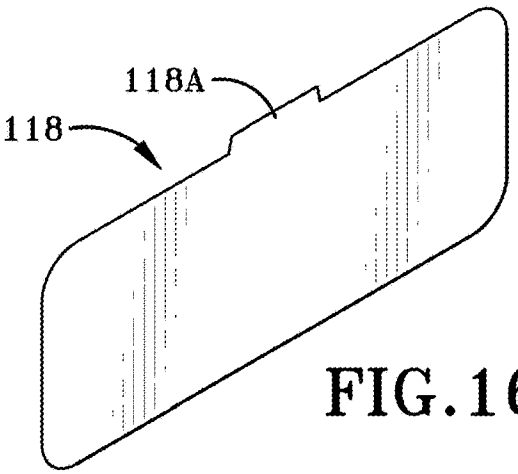
FIG. 16 is an alternative embodiment of the panel.
Figure 17:
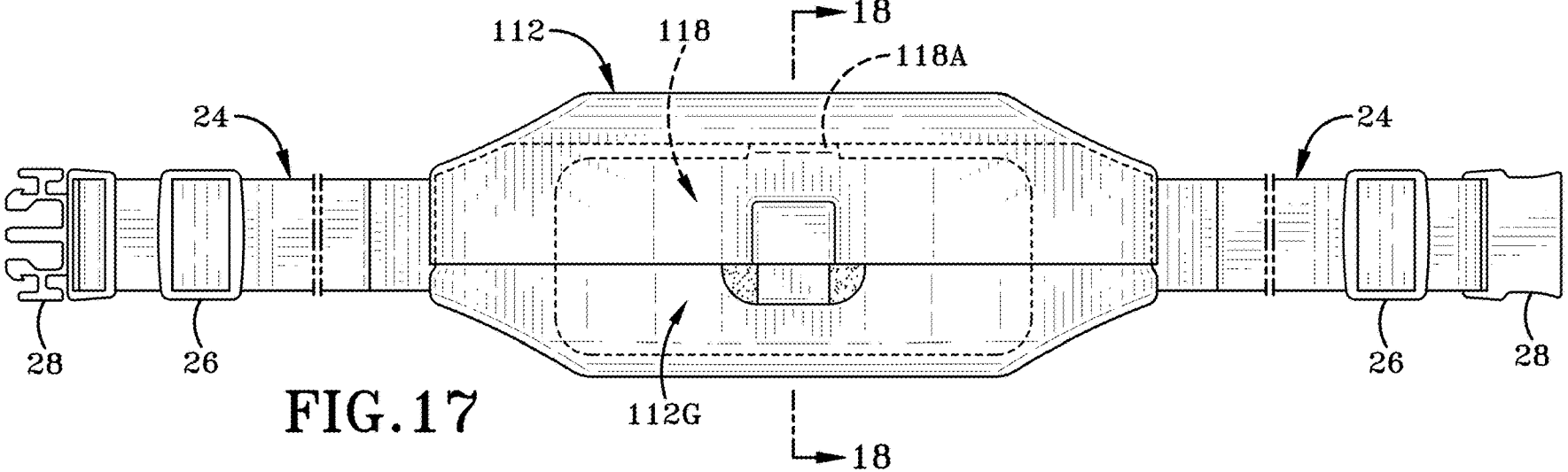
FIG. 17 is a front elevation view of an alternative embodiment of a running belt having the panel of FIG. 16.
Figure 18:
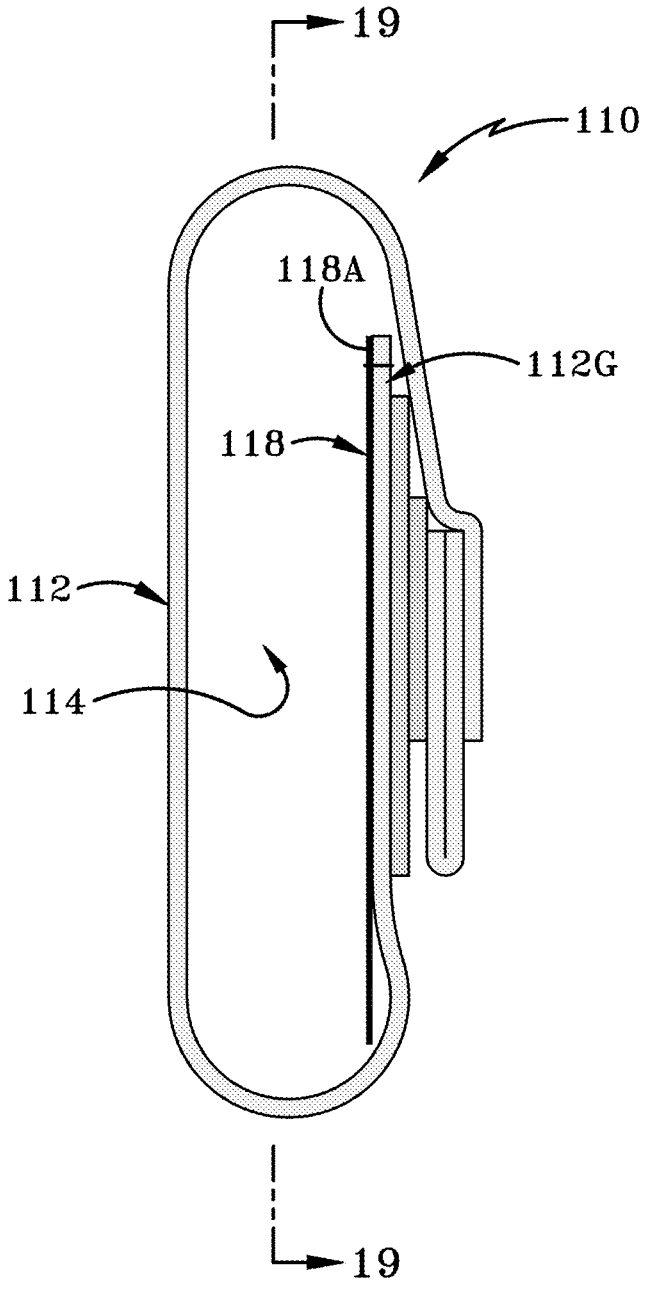
FIG. 18 is a diagrammatic cross section view of the alternative embodiment of the running belt taken in the direction of line 18-18 in FIG. 17.
Figure 19:
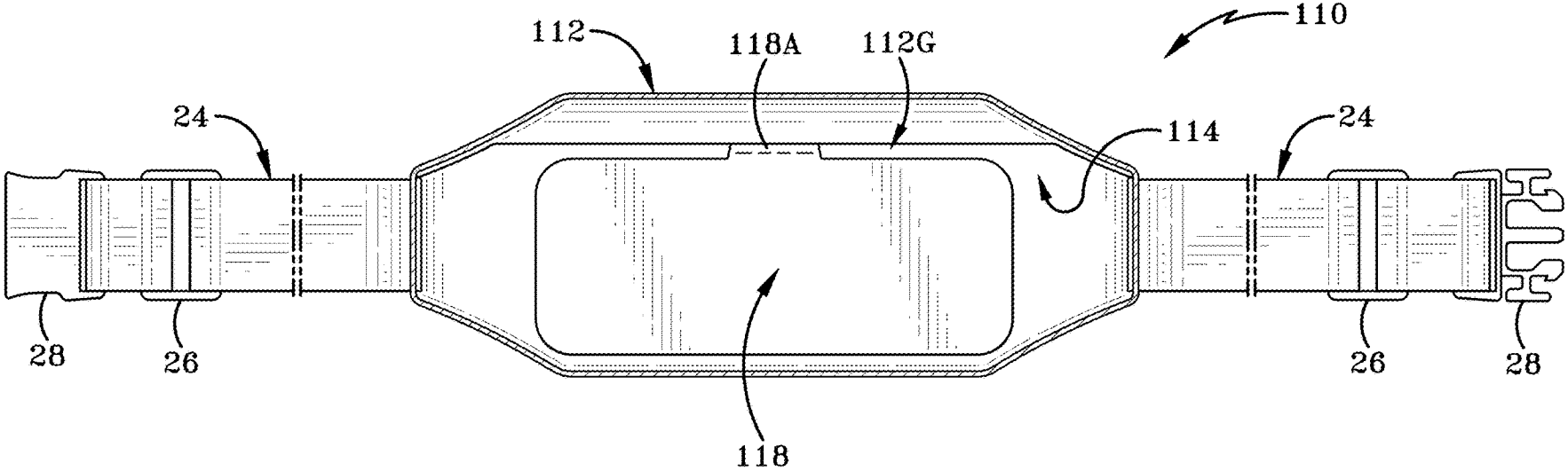
FIG. 19 is a diagrammatic cross section view of the alternative embodiment of the running belt taken in the direction of line 19-19 in FIG. 18.

In operation and with reference to FIG. 15A, when the user has pulled the pull tab 30 to release the connector 32 on top panel 12F from its connection with the corresponding connector 32 on bottom panel 12G to open the pouch (or opened the pouch in any other manner), the divider will be exposed and accessible to the user. The user will open the opening 34 in the divider by moving the zipper 36 in a lateral direction. Alternatively, the user may open the opening 34 in any other known manner if the zipper 36 is not present. When the opening 34 is opened, the user has access to the pocket 22 within the divider 16. Because the panel 18 is flexible or moveable, the user may push the panel rearward to enlarge the front portion 22A of pocket 22. This allows the user to insert an item 2 that is smaller than device 1, such as cash, coins, keys, or a credit card into the front portion 22A of pocket 22 (as seen in FIG. 15A). Alternatively, the user may push the panel forward to enlarge the rear portion 22B of pocket 22. This allows the user to insert the item 2 into the rear portion 22B of pocket 22 (as seen in FIG. 15B).

In addition to that which is shown in FIG. 15A-FIG. 15B, the pocket 22 may hold, secure and/or retain two items 2. One item may be located forward of the panel 18 in the front portion 22A of the pocket 22 and another item may be located rearward of the panel 18 in the rear portion 22B of the pocket 22. Because the shroud 20 of first material freely surrounds the top edge 18C of panel 18 and freely surrounds the bottom portion 18D of panel 18, the first material forming shroud 20 can stretch and flex to permit the two items to be snuggly secured in the pocket 22 with the panel 18 located between the two items. Alternatively, pocket 22 may function as containment area as extra security for primary compartment 14, the pocket 22 keeping small things (i.e., items 2) out of the way, and valuables extra secure for peace of mind, and with no worries of them accidentally falling out when something from primary compartment 14 is retrieved. The shroud being expandable can fit more items 2 (and bulge out to the front if needed).

Furthermore, the each of the shown configurations carrying either the device 1 or the item 2 can be combined with any other configuration. For example, the belt 10 may be utilized to carry one device 1 in the front portion 14A of the primary compartment and one item 2 in the front portion 22A of the pocket 22. The belt 10 may be utilized to carry one device 1 in the front portion 14A of the primary compartment and one item 2 in the rear portion 22B of the pocket 22. The belt 10 may be utilized to carry one device 1 in the rear portion 14B of the primary compartment and one item 2 in the front portion 22A of the pocket 22. The belt 10 may be utilized to carry one device 1 in the rear portion 14B of the primary compartment and one item 2 in the rear portion 22B of the pocket 22.

According to one exemplary aspect, the PP panel 18 is advantageous to managing getting the phone or object back into the primary compartment 14 more easily. The panel maintains the shape of the compartment 14 when the object 1 such as a phone is not inside. The panel 18 flexes to push the divider 16 forward and assists to place the object 1 inside the compartment 14. The panel 18 pushes the stretchy, sticky, rubbery, flexible neoprene (i.e., second material) out of the way along the entire shape of the panel 18 to push those flexible materials out of the way while opening the compartment the entire length of the panel 18, which manages the neoprene (i.e., second material) in a way that facilitates getting the phone or object 1 inside the compartment 14. This configuration manages and accounts for the flexible, stretchy neoprene second material without compromising the waterproof nature thereof. In another embodiment, a fixed panel (i.e., the panel stitched to the neoprene second material) could accomplish a similar objective but then there would be the compromise of stitching the outside neoprene (i.e., the stitching could reduce the waterproof capabilities).

The PP panel makes it easy for the user to get the phone or object 1 into primary compartment 14 without compromising the beneficial stretchiness horizontally which helps hold contents inside securely. The belt 10 holds the phone or object 1 securely inside compartment 14 even with the flap open b/c the divider stretches and holds the phone securely against the body with the flap (i.e., top front panel 12F) open. The zippered pocket still permits the divider 16 to stretch because the panel 18 is attached to the elastic belt 24 on the inside of the pocket 22. Together, these allow the user to leverage the stretchiness of the materials in a way that allows the user to see inside easily, stretch the materials wide to fit things inside while wearing the belt 10, keeps things secure, and not compromise the outside neoprene second material with stitching.

Additionally, the belt 10 may be utilized to carry two or more devices 1 (at least one device 1 in the front portion 14A of the primary compartment and at least one device 1 in the rear portion 14B of the primary compartment) and one item 2 in the front portion 22A of the pocket 22. The belt 10 may be utilized to carry two or more devices 1 (at least one device 1 in the front portion 14A of the primary compartment and at least one device in the rear portion 14B of the primary compartment) and one item 2 in the rear portion 22B of the pocket 22. The belt 10 may be utilized to carry one device 1 in either the front portion 14A or the rear portion 14B of the primary compartment and two or more items 2 in the pocket 22 (at least one item 2 in the front portion 22A and at least one item 2 in the rear portion 22B).

FIG. 16-FIG. 19 depicts an alternative embodiment of a running belt 110 that utilizes many of the same features of belt 10 and parts having similar reference elements are not repeated for brevity. Running belt 110 utilizes a panel 118 that is not located in a divider but rather affixed to the front lower panel 112G on the interior surface thereof to line or define or bound primary compartment 114 of pouch 112. Panel 118 may be formed from a PP material and have the same height dimension and lateral dimension as panel 18. Panel 118 affixed to the interior surface of lower front portion 112G would be stitched or attached to the tab 118A at its top edge. The remaining perimeter of panel 118 is not affixed to the lower front portion 112G of pouch 112. This allows the second material that forms pouch 112 to stretch. With the panel 118 only sewn along its tab 118A at the top edge, the pouch 112 would be able to stretch but still retain an overall flat configuration when viewed from the front to provide a sufficient structural shape to the primary compartment 114 when a device is inside the compartment 114. The panel 118 that is only stitched along the tab 118A at its top edge to the lower front portion 112G would keep the primary compartment relatively flat when the belt 110 is worn by the user and makes it easy to facilitate inserting and retrieving the device from the primary compartment 114.

One exemplary advantage of belt 10 is that the materials and configuration of divider 16 within the primary compartment 14 of pouch 12 may offer ergonomic benefits based on the natural positioning of the belt around a user's waist (or other part of their body) when inserting a device or removing a device from the pouch 12. The configuration of pouch 12 with the divider 16 takes advantage of the biometric alignment of the wrist and arm relative to an operational position of belt 10 resulting in improved comfort and reduced strain. Further, there may be some other benefits of the configuration of belt 10. For example, the material used to form panel 18 and shroud 20 can provide flexibility to easily move the divider 16 so that the user has direct line of sight to the device with the primary compartment 14 regardless of whether the device is in the front portion 14A or the rear portion 14B of compartment 14. Contrarily, a fixed divider can obstruct the line of sight, particularly when in dark, small and tight spaces.

The configuration of belt 10 can greatly facilitate cleaning efforts. Belt 10 enables cleaning to be more accessible and efficient. A user can easily reach into the primary compartment without hindrance due to the construction of divider 16, ensuring thorough cleaning practices are upheld. The presence of and combination of materials described herein minimizes the effort required to remove dirt, making the cleaning process more efficient.

The pouch 12 presents an excellent space for customization and branding. This area offers high visibility, making it an ideal spot to display logos, company names, or decorative patterns. Belt 10 can serve as effective marketing tools, promoting brand recognition and creating a professional and cohesive atmosphere. Customization options can extend to various industries and settings, including corporate offices, hospitality venues, educational institutions, and public spaces, allowing organizations to leave a lasting impression on users. The curvature of the belt 10 on the exterior of pouch 12 or on the divider 16 can serve as a natural contour for incorporating logos or brand symbols. By aligning the logo with the pouch 12 or divider 16, it can seamlessly follow the shape, creating a visually appealing and cohesive design. This not only reinforces brand identity but also enhances the overall aesthetics of the chair. The conforming curvature of belt 10 when worn by a user allows for creative and eye-catching logo placement, making it more noticeable and memorable to users. Belt 10 can also be utilized to accentuate brand colors. By applying the brand's signature colors to belt 10, it creates a visually striking effect.

Optionally, the belt 10 or 110 may additionally include one or more sensors to sense or gather data pertaining to the surrounding environment, the user's or wearer's activity level, or operation/location of the belt 10 or 110. Some exemplary sensors capable of being electronically coupled with the belt 10 or 110 (either directly connected to the belt 10 or 110 or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

The belt 10 or 110 may include wireless communication logic coupled to sensors on the belt 10 or 110. The sensors gather data and provide the data to the wireless communication logic. Then, the wireless communication logic may transmit the data gathered from the sensors to a remote device, such as a user or wearer-worn fitness activity tracker. Thus, the wireless communication logic may be part of a broader communication system, in which one or several belts 10 or 110 may be networked together to report alerts and, more generally, to be accessed and controlled remotely. Depending on the types of transceivers installed in the belt 10 or 110, the system may use a variety of protocols (e.g., Wifi, ZigBee, MiWi, Bluetooth) for communication. In one example, each of the belts 10 or 110 may have its own IP address and may communicate directly with a router or gateway. This would typically be the case if the communication protocol is WiFi.

In another example, a point-to-point communication protocol like MiWi or ZigBee is used. One or more of the belts 10 or 110 may serve as a repeater, or the belts 10 or 110 may be connected together in a mesh network to relay signals from one belt 10 or 110 to the next. However, the individual belt 10 or 110 in this scheme typically would not have IP addresses of their own. Instead, one or more of the belts 10 or 110 communicates with a repeater that does have an IP address, or another type of address, identifier, or credential needed to communicate with an outside network. The repeater communicates with the router or gateway.

In either communication scheme, the router or gateway communicates with a communication network, such as the Internet, although in some embodiments, the communication network may be a private network that uses transmission control protocol/internet protocol (TCP/IP) and other common Internet protocols but does not interface with the broader Internet, or does so only selectively through a firewall.

The system that receives and processes signals from belt 10 or 110 may differ from embodiment to embodiment. In one embodiment, alerts and signals from the belt 10 or 110 are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a user of a fitness mobile application. Thus, if a particular belt 10 or 110 creates an alert because of a data point gathered by one or more sensors, that alert can be sent, in e-mail or SMS form, directly to the individual responsible for monitoring the user's fitness level. Of course, e-mail and SMS are only two examples of communication methods that may be used; in other embodiments, different forms of communication may be used.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A running belt comprising:

a pouch forming a primary compartment, and the primary compartment is adapted to carry a device;

a divider within the pouch to divide the primary compartment into a first portion and a second portion, the divider comprising a panel surrounded by a first material; and an adjustable belt, wherein the adjustable belt is operable to retain the pouch about a portion of a user's body and the adjustable belt is operatively connected to the divider to retain the device within the compartment of the pouch the divider having a first end and a second end, wherein the first end of the divider and the second end of the divider are indirectly coupled with respective ends of the pouch and directly connected to the adjustable belt.

2. The running belt of claim 1, further comprising:

a pocket defined within the divider between the panel and the first material, and the pocket within the divider is adapted to carry an item that is smaller than the device.

3. The running belt of claim 2, further comprising:

a first surface on the panel;

a second surface on the panel, wherein the second surface faces an opposite direction as the first surface; and a first portion of the first material proximate the first surface on the panel, wherein the first portion of the first material defines an opening that is selectively opened and closed.

4. The running belt of claim 2, further comprising:

a zipper on the first portion of the first material that effectuates the opening to be selectively opened and closed, wherein the zipper is laterally aligned.

5. The running belt of claim 2, further comprising:

a first surface on the panel, wherein a first portion of the pocket within the divider is defined between the first surface of the panel and a front portion of the first material.

6. The running belt of claim 1, further comprising:

wherein the pouch comprises a second material that is different than the first material.

7. The running belt of claim 6, wherein the first material comprises elastane and the second material comprises neoprene; and wherein the panel comprises polypropylene (PP).

8. The running belt of claim 1, wherein the adjustable belt is connected to respective ends of the panel within the divider that is adapted to allow the divider to stretch and allow the pouch to stretch.

9. The running belt of claim 1, wherein the divider further comprises:

a top edge and a bottom edge on the panel;

a first end and second end on the panel;

wherein the first end and the second end on the panel are indirectly coupled to the first material, and the first material freely surrounds the top edge and the bottom edge on the panel.

10. The running belt of claim 9, wherein the first material that freely surrounds the panel defines a front portion of a pocket and a rear portion of the pocket within the divider.

11. The running belt of claim 1, further comprising:

a top of the divider and a bottom of the divider;

wherein the pouch freely surrounds the top of the divider and the bottom of the divider, and wherein there is no connection of the bottom of the divider to the pouch such that the first portion of the primary compartment is in open communication with the second portion of the primary compartment below the divider, and wherein there is no connection of the top of the divider to the pouch such that the first portion of the primary compartment is in open communication with the second portion of the primary compartment above the divider.

12. A running belt has a pouch that defines a primary compartment sized to receive at least a smartphone therein, and there is a divider within the compartment to divide the compartment into a front portion and a rear portion, wherein at least one of the front portion and the rear portion is adapted to retain the smartphone therein, and the divider defines an interior pocket that is divided into at least two portions by a panel within the pocket of the divider, and the pocket is sized to receive an item that is smaller than the smartphone therein, and the panel maintains a substantially constant shape of the divider when the smartphone is inserted into or removed from the primary compartment, and the divider is directly connected to respective ends of an adjustable belt.

13. A method comprising:

donning a belt having a pouch defining a primary compartment and having a divider located within the primary compartment, wherein the divider divides the primary compartment into a first portion and a second portion of the primary compartment; wherein the divider has a first end and a second end, wherein the first end of the divider and the second end of the divider are indirectly coupled with respective ends of the pouch and directly connected to the belt;

selectively inserting a device into either one of the first portion of the primary compartment or the second portion of the primary compartment;

adjusting the belt, wherein respective ends of the belt are directly connected to the divider within the primary compartment; and retaining the device within the primary compartment in response to adjustment of the belt.

14. The method of claim 13, further comprising:

opening the divider to reveal a pocket within the divider; and inserting an item into the divider, wherein the item is smaller than the device.

15. The method of claim 14, wherein the divider includes a panel that divides the pocket into a first portion and the second portion, the method further comprising:

selectively inserting the item into either one of the first portion of the pocket or the second portion of the pocket.

16. The method of claim 15, further comprising:

stretching a first material that surrounds the panel and defines the divider in response to insertion of the item, wherein the panel has a top edge and a bottom edge, and has a first end and second end, and wherein the first end and the second end on the panel are directly or indirectly coupled to the first material, and the first material freely surrounds the top edge and the bottom edge on the panel;

stretching a second material that forms the pouch in response to insertion of the device, wherein the divider has a top edge and a bottom edge, and the divider has a first end and second end, and wherein the first end and the second end on the divider are directly or indirectly coupled to the second material, and the second material freely surrounds the top edge and the bottom edge on the divider.

17. The method of claim 14, wherein opening the divider to reveal a pocket within the divider is accomplished by unzipping a laterally aligned zipper on a frontal portion of the divider.

18. The method of claim 14, further comprising:

flexing a panel located within the pocket of the divider prior to inserting the item into the pocket of the divider, wherein the panel is flexed prior to inserting the device into either one of the first portion of the primary compartment or the second portion of the primary compartment, wherein the panel is formed from polypropylene (PP).

19. The method of claim 13, further comprising:

opening the pouch via an overlap opening on a frontal portion of the pouch to provide access to the primary compartment.

20. The method of claim 13, further comprising:

maintaining an exterior profile shape of the divider via a panel located within the pocket of the divider when the item is inserted into the pocket of the divider and when the item is removed from the pocket of the divider.

* * * * *